US009118994B2

(12) United States Patent
Uchida et al.

(10) Patent No.: US 9,118,994 B2
(45) Date of Patent: Aug. 25, 2015

(54) CAPACITANCE SENSOR, ACOUSTIC SENSOR, AND MICROPHONE

(71) Applicant: OMRON Corporation, Kyoto-shi, Kyoto (JP)

(72) Inventors: Yuki Uchida, Shiga (JP); Takashi Kasai, Shiga (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 14/402,163

(22) PCT Filed: May 22, 2013

(86) PCT No.: PCT/JP2013/064289

§ 371 (c)(1),
(2) Date: Nov. 19, 2014

(87) PCT Pub. No.: WO2013/179991

PCT Pub. Date: Dec. 5, 2013

(65) Prior Publication Data

US 2015/0156576 A1 Jun. 4, 2015

(30) Foreign Application Priority Data

May 31, 2012 (JP) ..... 2012-125526

(51) Int. Cl.

| | |
|---|---|
| ***H04R 25/00*** | (2006.01) |
| ***H04R 1/08*** | (2006.01) |
| ***H04R 19/04*** | (2006.01) |
| ***H04R 19/00*** | (2006.01) |

(52) U.S. Cl.

CPC ..... *H04R 1/08* (2013.01); *H04R 19/005* (2013.01); *H04R 19/04* (2013.01); *H04R 2201/003* (2013.01)

(58) Field of Classification Search

CPC .... H04R 1/406; H04R 19/005; H04R 19/016; H04R 19/04; H04R 23/006; H04R 2201/003; H04R 31/003; B81B 2201/0257

USPC ..... 381/113, 116, 369, 173, 174, 175, 191; 29/25.41, 25.42, 594; 367/170, 174, 367/181; 438/53; 257/416

See application file for complete search history.

(56) References Cited

U.S. PATENT DOCUMENTS 6,535,460 B2 * 3/2003 Loeppert et al. ..... 367/181
8,351,625 B2 * 1/2013 Kasai ..... 381/175

(Continued)

FOREIGN PATENT DOCUMENTS

JP 2008-245267 A 10/2008
JP 4924853 B1 4/2012

OTHER PUBLICATIONS

International Search Report for corresponding International Application No. PCT/JP2013/064289, mailed Jul. 9, 2013 (1 page).

*Primary Examiner* — Huyen D Le
(74) *Attorney, Agent, or Firm* — Osha Liang LLP

(57) ABSTRACT

A capacitance sensor has a substrate, a vibration electrode plate formed over an upper side of the substrate, a back plate formed over the upper side of the substrate to cover the vibration electrode plate, and a fixed electrode plate arranged on the back plate facing the vibration electrode plate. At least one of the vibration electrode plate and the fixed electrode plate is divided into a plurality of regions. A sensing unit configured by the vibration electrode plate and the fixed electrode plate is formed on each of the divided regions. An isolation portion that suppresses vibration from being propagated is formed on the back plate to partition the sensing units from each other.

20 Claims, 26 Drawing Sheets

(56) References Cited

U.S. PATENT DOCUMENTS

| | | | | |
|---|---|---|---|---|
| 8,542,851 | B2 * | 9/2013 | Kasai | 381/175 |
| 2007/0047746 | A1 | 3/2007 | Weigold et al. | |
| 2007/0189556 | A1 * | 8/2007 | Tsuchiya | 381/174 |
| 2008/0205668 | A1 | 8/2008 | Torii et al. | |
| 2009/0316916 | A1 | 12/2009 | Haila et al. | |
| 2010/0183167 | A1 | 7/2010 | Phelps et al. | |

* cited by examiner

CAPACITANCE SENSOR, ACOUSTIC SENSOR, AND MICROPHONE

BACKGROUND

1. Technical Field

The present invention relates to a capacitance sensor, an acoustic sensor, and a microphone. More specifically, the present invention relates to a capacitance sensor configured by a capacitor structure including a vibration electrode plate (diaphragm) and a fixed electrode plate. The present invention also relates to an acoustic sensor (acoustic transducer) that converts acoustic vibration into an electric signal to output the electric signal and a microphone using the acoustic sensor. In particular, the present invention relates to a minute-sized capacitance sensor and a minute-sized acoustic sensor that are manufactured by using an MEMS (Micro Electro Mechanical System) technique.

2. Related Art

As a small-sized microphone mounted on a mobile phone or the like, an electret condenser microphone (Electret Condenser Microphone) has been popularly used. However, the electret condenser microphone is weak against heat, and is inferior to a MEMS microphone in corresponding to digitalization, reduction in size, high-functionalization/multi-functionalization, and power saving. For this reason, at present, the MEMS microphone has been popularized.

The MEMS microphone includes an acoustic sensor (acoustic transducer) that detects acoustic vibration and converts the acoustic vibration into an electric signal (detection signal), a drive circuit that applies a voltage to the acoustic sensor, and a signal processing circuit that performs signal processing such as amplification to the detection signal from the acoustic sensor to output the resultant signal to the outside. The acoustic sensor used in the MEMS microphone is an electrostatic capacitance acoustic sensor manufactured by using the MEMS technique. The drive circuit and the signal processing circuit are integrally manufactured as an ASIC (Application Specific Integrated Circuit) by using a semiconductor manufacturing technique.

In recent years, a microphone is required to high-sensitively detect sound having a low sound pressure to a high sound pressure. In general, the maximum input sound pressure of a microphone is limited by a total harmonic distortion (Total Harmonic Distortion). This is because, when sound having a high sound pressure is to be detected by a microphone, harmonic distortion occurs in an output signal to damage sound quality and accuracy. Thus, when the total harmonic distortion can be reduced to a low level, the maximum input sound pressure is increased to make it possible to widen a detection sound pressure range (to be referred to as a dynamic range) of the microphone.

However, in a general microphone, trade-off between improvement of detection sensitivity of acoustic vibration and a reduction in total harmonic distortion is established. For this reason, in a high-sensitive microphone that can detect sound having a small volume (low sound pressure), a total harmonic distortion of an output signal increases when the microphone receives sound having a large volume, and, therefore, the maximum detection sound pressure is limited. This is because the high-sensitive microphone outputs a greater signal and easily causes harmonic distortion. In contrast to this, when the harmonic distortion of the output signal is reduced to increase the maximum detection sound pressure, the sensitivity of the microphone is deteriorated to make it difficult to detect sound having a small volume with high quality. As a result, in a general microphone it is difficult to have a wide dynamic range from a small sound volume (low sound pressure) to a large sound volume (high sound pressure).

In the technical background, as a method of achieving a microphone having a wide dynamic range, a microphone using a plurality of acoustic sensors having different detection sensitivities is examined. As such a microphone, for example, a microphone disclosed in Patent Documents 1 to 4 is known.

Patent Documents 1 and 2 disclose a microphone in which a plurality of acoustic sensors are arranged and a plurality of signals from the plurality of acoustic sensors are switched or merged with each other depending on sound pressures. In the microphone, for example, a high-sensitive acoustic sensor that can detect a sound pressure level (SPL) of about 30 dB to 115 dB and a low-sensitive acoustic sensor that can detect a sound pressure level of about 60 dB to 140 dB are switched and used to make it possible to configure a microphone that can detect a sound pressure level of about 30 dB to 140 dB. Patent Documents 3 and 4 disclose one chip on which a plurality of independent acoustic sensors are formed.

FIG. 1A shows a relationship between a total harmonic distortion and a sound pressure in a high-sensitive acoustic sensor in Patent Document 1. FIG. 1B shows a relationship between a total harmonic distortion and a sound pressure in a low-sensitive acoustic sensor in Patent Document 1. FIG. 2 shows relationships between average displacement amounts and sound pressures of diaphragms in the high-sensitive acoustic sensor and the low-sensitive acoustic sensor in Patent Document 1. When it is assumed that an allowable total harmonic distortion is 20%, the maximum detection sound pressure of the high-sensitive acoustic sensor is about 115 dB. In the high-sensitive acoustic sensor, since an S/N ratio is deteriorated when the sound pressure is smaller than about 30 dB, the minimum detection sound pressure is about 30 dB. Thus, the dynamic range of the high-sensitive acoustic sensor is, as shown in FIG. 1A, about 30 dB to 115 dB. Similarly, when it is assumed that an allowable total harmonic distortion is 20%, the maximum detection sound pressure of the low-sensitive acoustic sensor is about 140 dB. The low-sensitive acoustic sensor has a diaphragm area smaller than that of the high-sensitive acoustic sensor, and, as shown in FIG. 2, has an average displacement amount of the diaphragm smaller than that of the high-sensitive acoustic sensor. Thus, the minimum detection sound pressure of the low-sensitive acoustic sensor is larger than the high-sensitive acoustic sensor, i.e., about 60 dB. As a result, the dynamic range of the low-sensitive acoustic sensor is, as shown in FIG. 1B, about 60 dB to 140 dB. When the high-sensitive acoustic sensor and the low-sensitive acoustic sensor as described above are combined with each other, a detectable sound pressure range, as shown in FIG. 1C, becomes wide, i.e., about 30 dB to 140 dB.

Patent Document 1: Publication of US patent application No. 2009/0316916

Patent Document 2: Publication of US patent application No. 2010/0183167

Patent Document 3: Japanese Unexamined Patent Publication No. 2008-245267

Patent document 4: Publication of US patent application No. 2007/0047746

SUMMARY

A total harmonic distortion is defined as follows. A waveform indicated by a solid line in FIG. 3A is a basic sinusoidal waveform having a frequency f1. When this basic sinusoidal waveform is Fourier-transformed, a spectrum component occurs at only a position corresponding to the frequency f1. It is assumed that the basic sinusoidal waveform in FIG. 3A is distorted by some reason like a waveform indicated by a broken line in FIG. 3A. It is assumed that, when the distorted waveform is Fourier-transformed, a frequency spectrum as shown in FIG. 3B is obtained. More specifically, it is assumed that the distorted waveform has FFT intensities (Fast Fourier Transformation intensities) V1, V2, . . . , V5 at frequencies f1, f2, . . . , f5, respectively. At this time, a total harmonic distortion (THD) of the distorted waveform is defined by the following numerical expression 1.

[Numerical Expression 1]

$$THD = \frac{\sqrt{V2^2 + V3^2 + V4^2 + V5^2}}{V1} \quad \text{(Numerical Expression 1)}$$

However, in a microphone described in Patent Documents 1 to 4, even though a plurality of acoustic sensors are formed on different chips, respectively, or a plurality of acoustic sensors are integrally formed on one chip (substrate), the acoustic sensors have independent capacitor structures, respectively. For this reason, in such a microphone, a fluctuation of acoustic characteristics and mismatching of acoustic characteristics occur. Hereinafter, the fluctuation of acoustic characteristics means a difference between acoustic characteristics of acoustic sensors in different chips. The mismatching of acoustic characteristics means a difference between acoustic characteristics of a plurality of acoustic sensors in the same chip.

More specifically, when the acoustic sensors are formed on different chips, due to fluctuations in warpage and thickness of diaphragms to be manufactured, a fluctuation in detection sensitivity between the chips occurs. As a result, the fluctuation of the chips related to a difference between the detection sensitivities of the acoustic sensors increases. Even though independent acoustic sensors are integrally formed on one common chip, in manufacturing of capacitor structures of the acoustic sensors by using the MEMS technique, gap distances between diaphragms and fixed electrodes easily fluctuate. Furthermore, a back chamber and a vent hole are independently formed as a result, mismatching in a chip occurs in acoustic characteristics such as frequency characteristics and phases influenced by the back chamber and the vent hole.

One or more embodiments of the present invention provides a capacitance sensor and an acoustic sensor in each of which a plurality of sensing units having different sensitivities are integrally formed to achieve a wide dynamic range, small mismatching between the sensing units, and reduction in harmonic distortion.

According to one or more embodiments of the present invention, there is provided a capacitance sensor according to one or more embodiments of the present invention including a vibration electrode plate formed over an upper side of a substrate, a back plate formed over the upper side of the substrate to cover the vibration electrode plate, and a fixed electrode plate arranged on the back plate to face the vibration electrode plate, in which at least one of the vibration electrode plate and the fixed electrode plate is divided into a plurality of regions, a sensing unit configured by the vibration electrode plate and the fixed electrode plate is formed on each of the divided regions, and an isolation portion to suppress vibration from being propagated is formed on the back plate to partition the sensing units from each other.

According to the capacitance sensor according to one or more embodiments of the present invention, since at least one of the vibration electrode plate and the fixed electrode plate is divided, a plurality of sensing units (variable capacitor structures) are formed between the vibration electrode plate and the fixed electrode plate. Thus, each of the divided sensing units can output an electric signal, and a change in pressure such as acoustic vibration can be converted into a plurality of electric signals and output. According to the capacitance sensor, for example, the areas of the vibration electrode plates of each of the sensing units are made different from each other or displacement amounts of the vibration electrode plates are made different from each other to make it possible to make detection ranges or sensitivities of the sensing units different from each other, and the signals are switched and combined with each other to make it possible to widen a detection range without deteriorating the sensitivity.

Since the plurality of sensing units can be formed by dividing the vibration electrode plate or the fixed electrode plate that are simultaneously manufactured, in comparison with a conventional art having a plurality of sensing units that are separately manufactured and independent of each other, a fluctuation of characteristics between the sensing units decreases. As a result, a fluctuation of characteristics caused by a difference between the detection sensitivities of the sensing units can be reduced. Since the sensing units share the vibration electrode plate and the fixed electrode plate, mismatching related to characteristics such as frequency characteristics and phases can be reduced.

In the capacitance sensor according to one or more embodiments of the present invention, the sensing unit is formed in each of the divided regions of the vibration electrode plate or the fixed electrode plate, an isolation portion to suppress vibration from being propagated is formed on the back plate to partition the sensing units from each other. For this reason, even though a diaphragm collides with the back plate in the sensing unit in a certain region to generate distortion vibration, the back plate is separated from other sensing units by the isolation portion, and the distortion vibration does not easily transmit to the other sensing units. As a result, distortion vibration generated by a certain sensing unit does not easily spread to the other sensing units through the back plate and does not easily deteriorate the total harmonic distortions of the other sensing units. In particular, according to the capacitance sensor according to one or more embodiments of the present invention, since distortion vibration generated by a high-sensitive sensing unit does not easily transmit to a low-sensitive sensing units, the total harmonic distortion of the low-sensitive sensing unit can be prevented from being deteriorated, and a dynamic range of the low-sensitive sensing unit can be prevented from being narrowed.

In a capacitance sensor according to one or more embodiments of the present invention, the isolation portion is 1 or 2 or more slits formed in the back plate. Accordingly, the slit need only be formed in the back plate in formation of the back plate, and the isolation portion can be easily manufactured by a MEMS technique.

In a capacitance sensor according to one or more embodiments of the present invention, in a capacitance sensor in which an isolation portion is a slit in a back plate, the slit of the back plate penetrates the back plate from an upper surface to a lower surface of the back plate. Accordingly, distortion vibration does not easily transmit between the sensing units, and a suppressing effect of harmonic distortion is improved. Since the slit penetrates the back plate, air molecules in the sensing unit can be escaped from the slit of the back plate to the outside, noise caused by thermal noise can be reduced.

In a capacitance sensor according to one or more embodiments of the present invention, in a capacitance sensor in which an isolation portion is a slit in a back plate, a notch is formed at an end of the slit in the back plate. Accordingly, since the notch is formed at the end of the slit of the back plate, stress is not easily concentrated on the end of the slit of the back plate, and the slit of the back plate is not easily damaged by residual stress, dropping impact, or the like.

In a capacitance sensor according to one or more embodiments of the present invention, the notch has a diameter larger than a width of the slit of the back plate. The diameter of the notch is set to be larger than the width of the slit of the back plate to improve the effect of moderating stress concentration.

When a plurality of holes are formed in the back plate and the fixed electrode plate, as a mode of the slit of the back plate, (1) the slit of the back plate may straightly extend to avoid the holes, and (2) the slit of the back plate may straightly extend through the holes. (3) The slit of the back plate may zigzag extend through the holes, and (4) the slit of the back plate may be discontinuously formed to connect the holes to each other.

Furthermore, the plurality of slits formed in the back plate may be intermittently formed to partition the sensing units from each other. When the slit of the back plate is intermittently formed, the strength of the back plates between the sensing units is not easily deteriorated.

The isolation portion can be formed by not only the slit of the back plate, but also a material or a structure that can suppress vibration from being propagated.

In a capacitance sensor according to one or more embodiments of the present invention, at a peripheral portion of the isolation portion, a stopper is projected from the lower surface of the back plate. When the isolation portion such as a slit is formed in the back plate, an edge of the isolation portion of the back plate is easily bent, and the back plate and the diaphragm may be fixed to each other. Thus, at the peripheral portion of the isolation portion, the stopper is desirably projected from the lower surface of the back plate to make the back plate and the diaphragm difficult to be fixed to each other.

In a capacitance sensor according to one or more embodiments of the present invention, the vibration electrode plate is divided by a slit into a plurality of regions, and the isolation portion is located immediately over the slit of the vibration electrode plate. When the isolation portion is formed in the vibration electrode plate, a portion near the slit of the vibration electrode plate is a boundary between a position where the vibration electrode plate easily collides with the back plate and a position where the vibration electrode plate does not easily collides with the back plate. Thus, according to one or more embodiments of present invention, the isolation portion is formed in the back plate immediately over the vibration electrode plate, distortion vibration caused by collision is suppressed from transmitting from a region in which collision easily occurs to a region in which collision does not easily occur.

An acoustic sensor according to one or more embodiments of the present invention is an acoustic sensor using the capacitance sensor according to one or more embodiments of the present invention in which a plurality of holes to cause acoustic vibration to pass are formed in the back plate and the fixed electrode plate, and a signal is output from the sensing unit by a change in electrostatic capacitance between the diaphragm and the fixed electrode plate that respond to the acoustic vibration.

In the acoustic sensor having a plurality of sensing units, when acoustic vibration having a high sound pressure acts, the vibration electrode plate collides with the back plate in a high-sensitive sensing unit to easily cause distortion vibration. However, in the acoustic sensor according to one or more embodiments of the present invention, the isolation portion is formed in the back plate to make it difficult to transmit distortion vibration to a low-sensitive sensing unit. Thus, harmonic distortion of a low-sensitive sensing unit can be prevented from being increased by distortion vibration generated on a high-sensitivity side, and a dynamic range of the acoustic sensor can be prevented from being narrowed.

A microphone according to one or more embodiments of the present invention includes the acoustic sensor according to one or more embodiments of the present invention, and a circuit unit that amplifies a signal from the acoustic sensor to output the amplified signal to the outside. In the microphone according to one or more embodiments of the present invention, harmonic distortion of a low-sensitive sensing unit can be prevented from being increased by distortion vibration generated on a high-sensitivity side, and a dynamic range of the microphone can be prevented from being narrowed.

DETAILED DESCRIPTION

Embodiments of the present invention will be described below with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. The present invention is not limited to the following embodiments, and can be variously changed in design without departing from the spirit and scope of the invention. In particular, an acoustic sensor and a microphone will be exemplified below. However, the present invention can be applied to not only the acoustic sensor but also a capacitance sensor such as a pressure sensor.

First Embodiment

Figure 1:
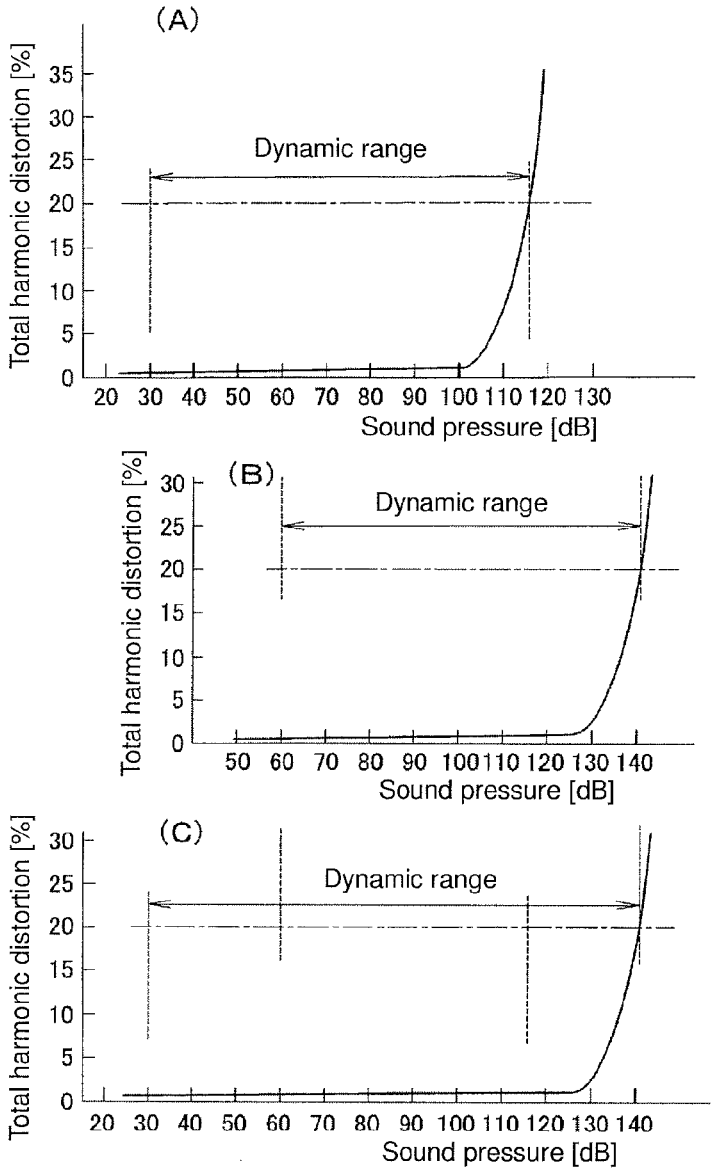
FIG. 1A is a diagram showing a relationship between a total harmonic distortion and a sound pressure in a high-sensitive acoustic sensor in Patent Document 1.
FIG. 1B is a diagram showing a relationship between a total harmonic distortion and a sound pressure in a low-sensitive acoustic sensor in Patent Document 1.
FIG. 1C is a diagram showing relationships between a total harmonic distortion and a sound pressure when the high-sensitive acoustic sensor and the low-sensitive acoustic sensor in Patent Document 1 are combined with each other.
Figure 2:
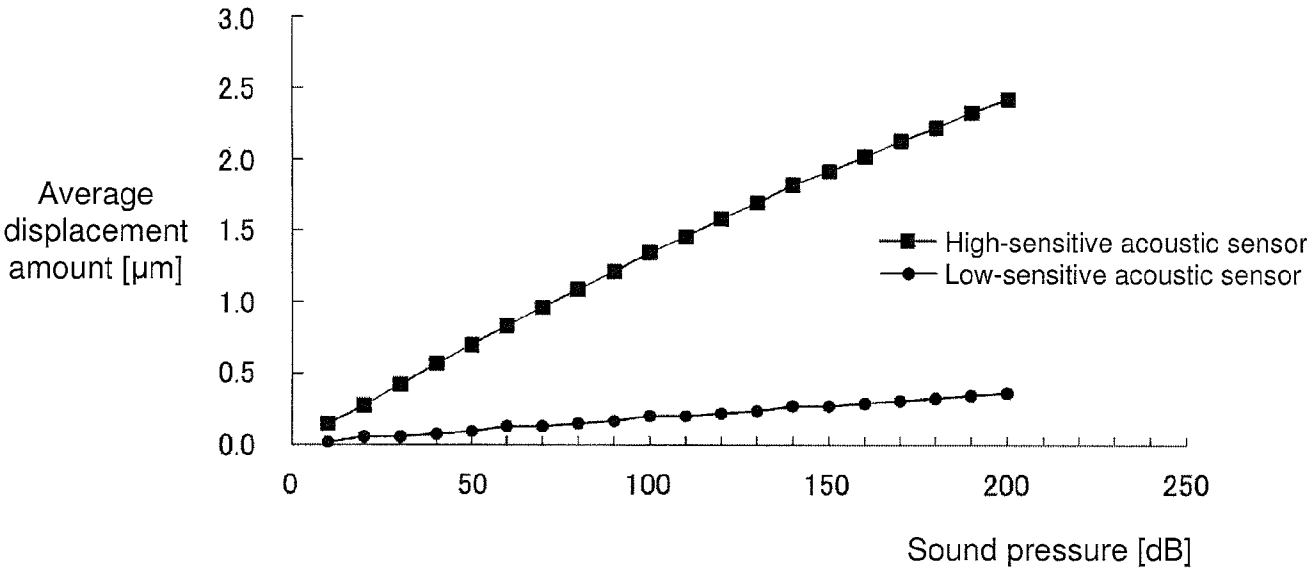
FIG. 2 is a diagram showing a relationship between average displacement amounts and sound pressures of diaphragms in the high-sensitive acoustic sensor and the low-sensitive acoustic sensor in Patent Document 1.
Figure 3:
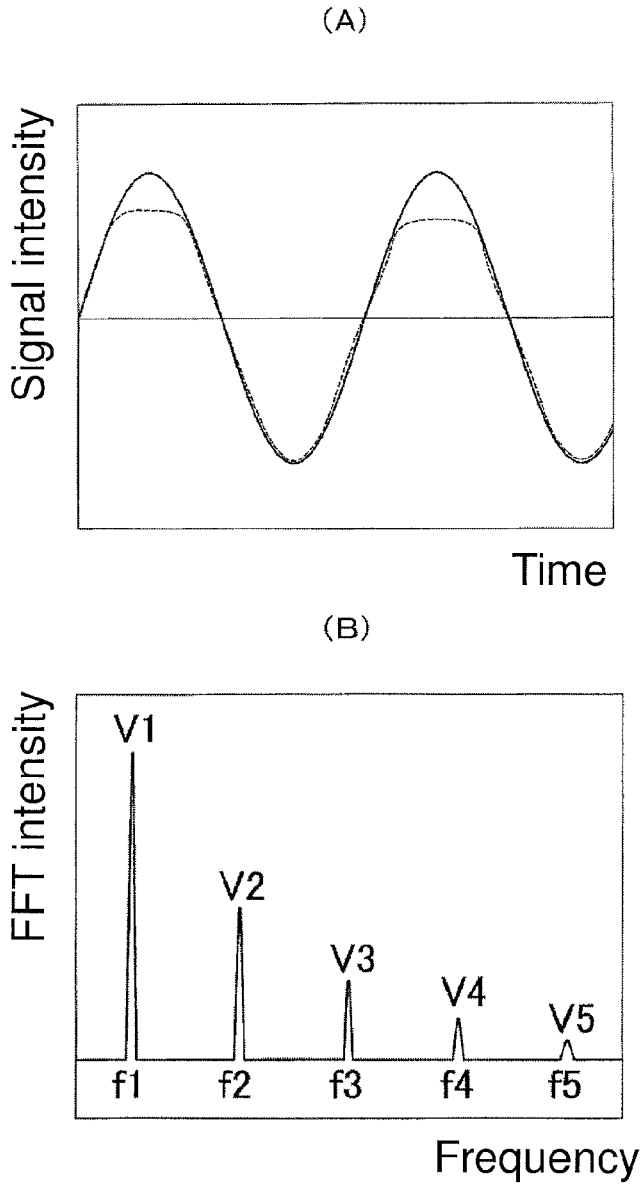
FIG. 3A shows a basic waveform and a waveform including distortion.
FIG. 3B is a frequency spectral map of the distorted waveform shown in FIG. 3A.
Figure 4:
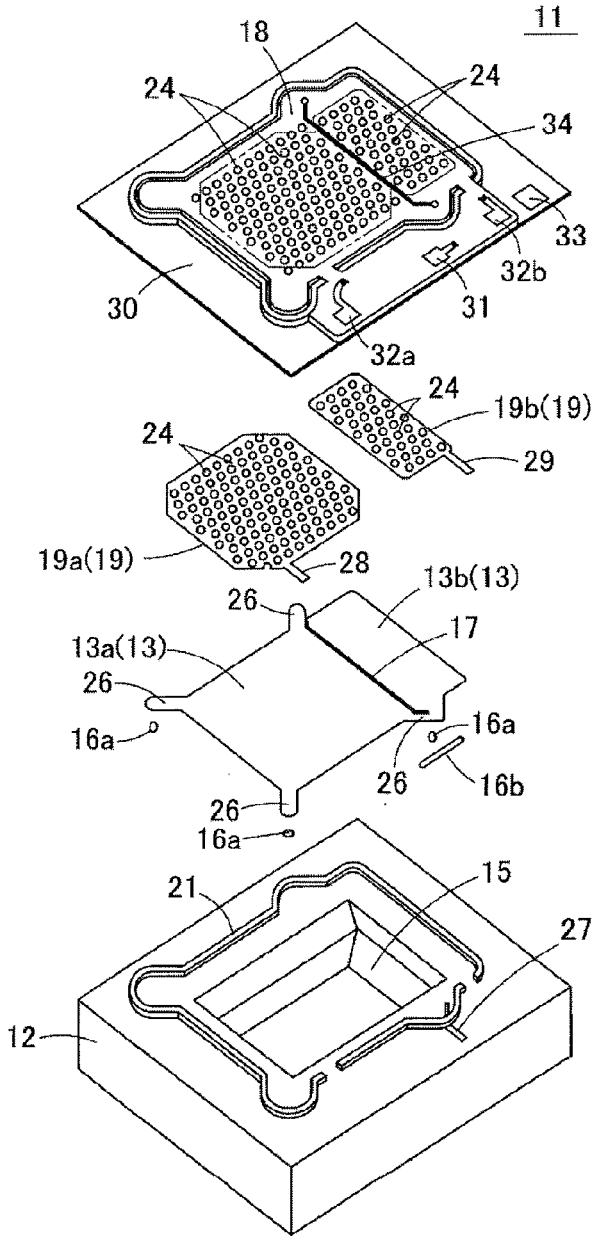
FIG. 4 is an exploded perspective view of an acoustic sensor according to a first embodiment of the present invention.
Figure 5:
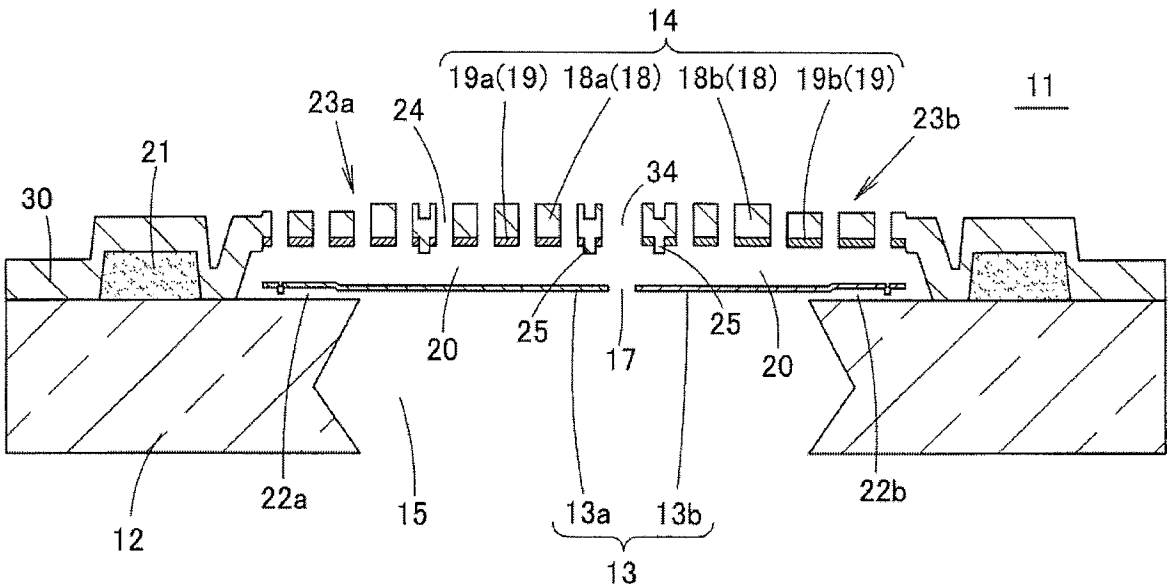
FIG. 5 is a sectional view of the acoustic sensor according to the first embodiment of the present invention.
Figure 6:
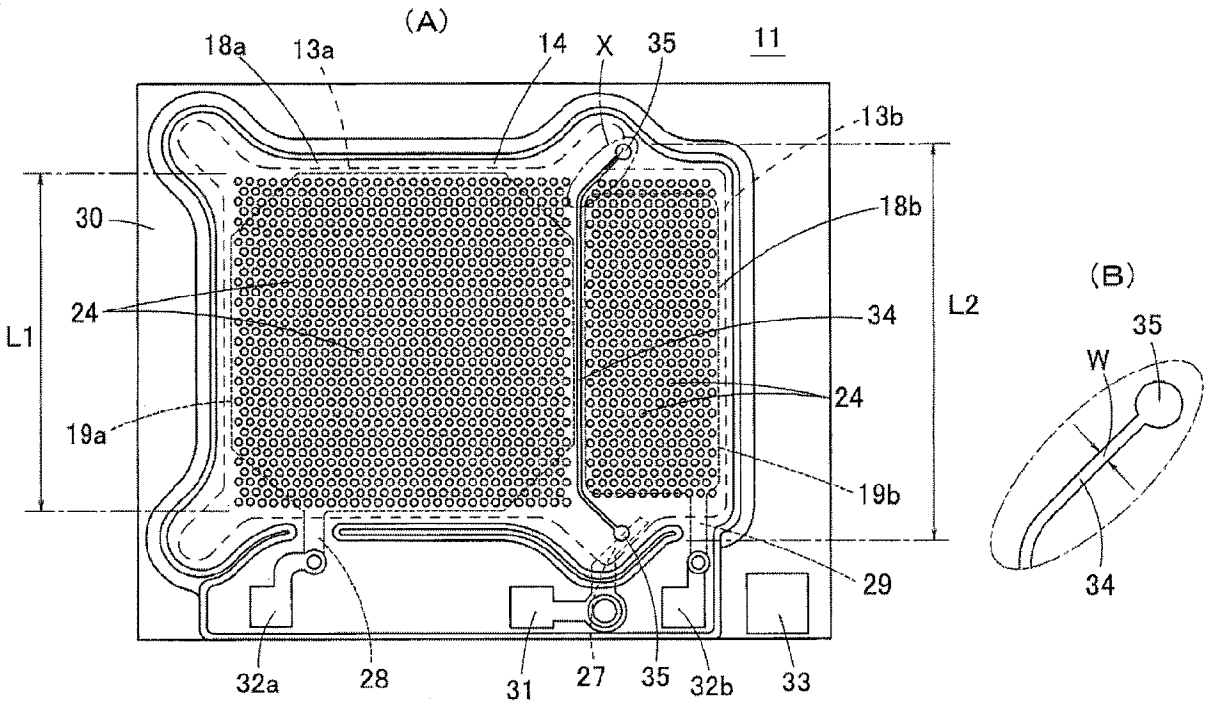
FIG. 6A is a plan view of the acoustic sensor according to the first embodiment of the present invention.
FIG. 6B is an enlarged view of an X portion in FIG. 6A.
Figure 7:
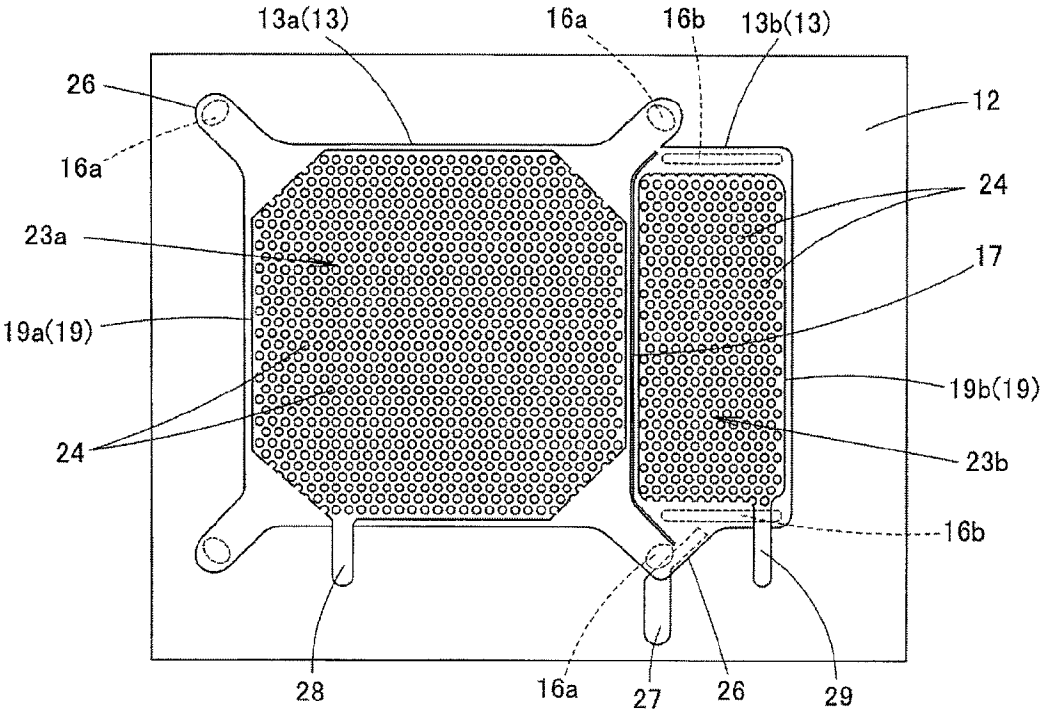
FIG. 7 is a plan view showing a state in which a back plate, a protecting film, and the like are removed from the acoustic sensor shown in FIG. 6A.

A structure of an acoustic sensor according to a first embodiment of the present invention will be described below with reference to FIGS. 4 to 7. FIG. 4 is an exploded perspective view of an acoustic sensor 11 according to the first embodiment of the present invention. FIG. 5 is a sectional view of the acoustic sensor 11. FIG. 6A is a plan view of the acoustic sensor 11. FIG. 6B is an enlarged view of an X portion in FIG. 6A. FIG. 7 is a plan view of the acoustic sensor 11 from which a back plate 18, a protecting film 30, and the like are removed, and shows a manner in which a diaphragm 13 and a fixed electrode plate 19 overlap above a silicon substrate 12. These drawings do not reflect manufacturing steps of the acoustic sensor 11 by MEMS.

The acoustic sensor 11 is an electrostatic capacitor element manufactured by using a MEMS technique. As shown in FIGS. 4 and 5, in the acoustic sensor 11, a diaphragm 13 is formed on the upper surface of the silicon substrate 12 (substrate) through anchors 16*a* and 16*b*, a lid unit 14 is arranged above the diaphragm 13 through a very small air gap 20 (void), and the lid unit 14 is fixed to the upper surface of the silicon substrate 12.

In the silicon substrate 12 made of single-crystalline silicon, a chamber 15 (cavity portion) is formed to penetrate the silicon substrate 12 from the upper surface to the rear surface. Although the illustrated chamber 15 has wall surfaces configured by inclined surfaces formed by a (111) plane of a (100) plane silicon substrate and a plane equivalent to the (111) plane, the wall surfaces of the chamber 15 may be vertical surfaces.

The diaphragm 13 is arranged above the silicon substrate 12 to cover the upper side of the chamber 15. As shown in FIG. 4 and FIG. 7, the diaphragm 13 is formed to have a nearly rectangular shape. The diaphragm 13 is formed by a polysilicon thin film having conductivity, and the diaphragm 13 itself serves as a vibration electrode plate. The diaphragm 13 is divided into two small and large regions by a nearly straight slit 17 extending in a direction parallel to the short side. However, the diaphragm 13 is not completely divided by two by the slit 17, and the divided diaphragms 13 are mechanically and electrically connected to each other near an end of the slit 17. Hereinafter, of the two regions divided by the slit 17, a nearly rectangular region having a large area is called a first diaphragm 13*a*, and a nearly rectangular region having an area smaller than that of the first diaphragm 13*a* is called a second diaphragm 13*b*.

The first diaphragm 13*a* is supported on the upper surface of the silicon substrate 12 such that leg pieces 26 arranged at the corners of the first diaphragm 13*a* are supported by anchors 16*a* and the first diaphragm 13*a* is floated from the upper surface of the silicon substrate 12. Between the adjacent anchors 16*a*, a narrow vent hole 22*a* to cause acoustic vibration to pass is formed between a lower surface of an outer peripheral portion of the first diaphragm 13*a* and the upper surface of the silicon substrate 12.

The second diaphragm 13*b* is supported on the upper surface of the silicon substrate 12 such that both the short sides are supported by anchors 16*b* and the second diaphragm 13*b* is floated from the upper surface of the silicon substrate 12. Between a lower surface of a long side of the second diaphragm 13*b* and the upper surface of the silicon substrate 12, a narrow vent hole 22*b* to cause acoustic vibration to pass is formed.

Both the first diaphragm 13*a* and the second diaphragm 13*b* are located at equal levels from the upper surface of the silicon substrate 12. More specifically, the vent hole 22*a* and the vent hole 22*b* serve as spaces having equal heights. A drawing wire 27 arranged on the upper surface of the silicon substrate 12 is connected to the diaphragm 13. Furthermore, on the upper surface of the silicon substrate 12, a band-like base portion 21 is formed to surround the diaphragm 13. The anchors 16*a* and 16*b* and the base portion 21 are made of $SiO_2$.

As shown in FIG. 5, the lid unit 14 is formed such that the fixed electrode plate 19 made of polysilicon is arranged on the lower surface of the back plate 18 made of SiN. The lid unit 14 is formed in the form of a dome and has a cavity portion thereunder, and the cavity portion covers the diaphragms 13*a* and 13*b*. The very small air gap 20 (cavity) is formed between the lower surface (i.e., the lower surface of the fixed electrode plate 19) of the lid unit 14 and the upper surfaces of the diaphragms 13*a* and 13*b*.

The fixed electrode plate 19 is divided into a first fixed electrode plate 19*a* facing the first diaphragm 13*a* and a second fixed electrode plate 19*b* facing the second diaphragm 13*b*, and the fixed electrode plates 19*a* and 19*b* are electrically separated from each other. The first fixed electrode plate 19*a* has an area larger than that of the second fixed electrode plate 19*b*. A drawing wire 28 is drawn from the first fixed electrode plate 19*a*, and a drawing wire 29 is drawn from the second fixed electrode plate 19*b*.

The first diaphragm 13*a* and the first fixed electrode plate 19*a* facing each other through the air gap 20 form a first acoustic sensing unit 23*a* having a capacitor structure. The second diaphragm 13*b* and the second fixed electrode plate 19*b* facing each other through the air gap 20 form a second acoustic sensing unit 23*b* having a capacitor structure. A gap distance of the air gap 20 in the first acoustic sensing unit 23*a* is equal to a gap distance of the air gap 20 in the second acoustic sensing unit 23*b*. A division position between the first and second diaphragms 13*a* and 13*b* and a division position between the first and second fixed electrode plates 19*a* and 19*b* are matched with each other in the illustrated example. However, the division positions may be different from each other.

In the first acoustic sensing unit 23*a*, in the lid unit 14 (i.e., the back plate 18 and the first fixed electrode plate 19*a*), a large number of acoustic holes 24 (acoustic holes) to cause acoustic vibration to pass are formed to penetrate the lid unit 14 from the upper surface to the lower surface. Also in the second acoustic sensing unit 23*b*, in the lid unit 14 (i.e., the back plate 18 and the second fixed electrode plate 19*b*), a large number of acoustic holes 24 (acoustic holes) to cause acoustic vibration to pass are formed to penetrate the lid unit 14 from the upper surface to the lower surface. In the illustrated example, although the hole diameters and the pitch of the acoustic holes 24 in the first acoustic sensing unit 23*a* are equal to those in the second acoustic sensing unit 23*b*, the hole diameters and the pitches of the acoustic holes are different from each other in both the acoustic sensing units 23*a* and 23*b* in some cases.

As shown in FIG. 6 and FIG. 7, the acoustic holes 24 are regularly arrayed in both the acoustic sensing units 23*a* and 23*b*. In the illustrated example, the acoustic hole 24 are arrayed in the form of a triangle along three directions forming angles of 120°. However, the acoustic holes 24 may be arranged in the form of a rectangle, a concentric circle, or the like.

In the back plate 18, an isolation portion, i.e., a back plate slit 34 (which may be simply referred to as a slit 34 hereinafter when there is no possibility of erroneously regarding the slit as a slit of a diaphragm) is formed to partition the first acoustic sensing unit 23*a* and the second acoustic sensing unit 23*b* from each other. The slit 34 passes between the first fixed electrode plate 19*a* and the second fixed electrode plate 19*b* and penetrates the back plate 18 from the upper surface to the lower surface thereof. In the following description, on the back plate 18, a region on the first acoustic sensing unit 23*a* divided by the slit 34 is represented by a back plate 18*a*, and a region on the second acoustic sensing unit 23*b* divided by the slit 34 is represented by a back plate 18*b*. At both the ends of slit 34, circular notches 35 (notches) each of which has a diameter larger than a width W of the slit 34 and vertically penetrates the slit 34 are formed. In the illustrated example, although the slit 34 penetrates the back plate 18 from the upper surface to the lower surface thereof, the slit 34 may be formed such that a part of the back plate 18 remains in the slit 34 to cause a section perpendicular to the longitudinal direction of the slit 34 to have a concave shape. In the illustrated example, although the back plate 18*a* and the back plate 18*b* are partially connected to each other, both the back plates 18*a* and 18*b* may be separated from each other by the slit 34.

As shown in FIG. 5, even in the first acoustic sensing unit 23*a* and the second acoustic sensing unit 23*b*, very small stoppers 25 (projections) each having a columnar shape project from the lower surface of the lid unit 14. The stoppers 25 integrally project from the lower surface of the back plate 18, penetrate the first and second fixed electrode plates 19*a* and 19*b*, and project from the lower surface of the lid unit 14. Since the stoppers 25 are made of SiN like the back plate 18, the stoppers 25 have insulativity. The stoppers 25 are used to prevent the diaphragms 13*a* and 13*b* from being fixed to and adhering to the fixed electrode plates 19*a* and 19*b* by electrostatic force.

The protecting film 30 continuously extends from the whole outer edge of the back plate 18 having a lid-like shape. The protecting film 30 covers the base portion 21 and a silicon substrate surface outside the base portion 21.

On the upper surface of the protecting film 30, a common electrode pad 31, a first electrode pad 32*a*, a second electrode pad 32*b*, and a ground electrode pad 33 are arranged. The other end of the drawing wire 27 connected to the diaphragm 13 is connected to the common electrode pad 31. The drawing wire 28 drawn from the first fixed electrode plate 19*a* is connected to the first electrode pad 32*a*, and the drawing wire 29 drawn from the second fixed electrode plate 19*b* is connected to the second electrode pad 32*b*. The electrode pad 33 is connected to the silicon substrate 12 and is kept at a ground potential.

In the acoustic sensor 11, when acoustic vibration enters the chamber 15 (front chamber), the diaphragms 13*a* and 13*b* that are thin films vibrate in the same phase with the acoustic vibration. When the diaphragms 13*a* and 13*b* vibrate, the electrostatic capacitances of the acoustic sensing units 23*a* and 23*b* change. As a result, in the acoustic sensing units 23*a* and 23*b*, acoustic vibration (change in sound pressure) sensed by the diaphragms 13*a* and 13*b* becomes a change in electrostatic capacitance between the diaphragms 13*a* and 13*b* and the fixed electrode plates 19*a* and 19*b*, and the change in the electrostatic capacitance is output as an electric signal. In a different using mode, more specifically, in a using mode in which the chamber 15 is used as a back chamber, acoustic vibration passes through the acoustic holes 24*a* and 24*b* and enters the air gap 20 in the lid unit 14 to vibrate the diaphragms 13*a* and 13*b* serving as thin films.

Since the area of the second diaphragm 13*b* is smaller than the area of the first diaphragm 13*a*, the second acoustic sensing unit 23*b* serves as a low-sensitive acoustic sensor for a sound pressure range from an intermediate volume to a large volume, and the first acoustic sensing unit 23*a* serves as a high-sensitive acoustic sensor for a sound pressure range from a small volume to an intermediate volume. Thus, the acoustic sensing units 23*a* and 23*b* are used as a hybrid sensing unit to cause a processing circuit (will be described later) to output a signal, so that the dynamic range of the acoustic sensor 11 can be widened. For example, the dynamic range of the first acoustic sensing unit 23*a* is set to be about 30 to 120 dB, and the dynamic range of the second acoustic sensing unit 23*b* is set to be about 50 to 140 dB. In this case, both the acoustic sensing units 23*a* and 23*b* are combined with each other to make it possible to widen the dynamic range to about 30 to 140 dB. When the acoustic sensor 11 is divided into the first acoustic sensing unit 23*a* for a range from a small volume to an intermediate volume and the second acoustic sensing unit 23*b* for a range from an intermediate volume to a large volume, an output from the first acoustic sensing unit 23*a* can be prevented from being used for a large volume, and the first acoustic sensing unit 23*a* may have a large total harmonic distortion in a high sound pressure range without a problem. Thus, the sensitivity of the first acoustic sensing unit 23*a* for a small volume can be increased.

Furthermore, in the acoustic sensor 11, the first acoustic sensing unit 23*a* and the second acoustic sensing unit 23*b* are formed on the same substrate. In addition, the first acoustic sensing unit 23*a* and the second acoustic sensing unit 23*b* are configured by the first diaphragm 13*a* and the second diaphragm 13*b* obtained by dividing the diaphragm 13 and the first fixed electrode plate 19*a* and the second fixed electrode plate 19*b* obtained by dividing the fixed electrode plate 19, respectively. More specifically, since a sensing unit that is originally one unit is divided by two to make the first acoustic sensing unit 23*a* and the second acoustic sensing unit 23*b* hybrid, in comparison with a conventional art in which two independent sensing units are formed on one substrate or a conventional art in which sensing units are formed on different substrates, respectively, fluctuations in detection sensitivity of the first acoustic sensing unit 23*a* and the second acoustic sensing unit 23*b* are similar to each other. As a result, the fluctuations in detection sensitivity between both the acoustic sensing units 23*a* and 23*b* can be reduced. Since both the acoustic sensing units 23*a* and 23*b* share the diaphragm and the fixed electrode plate, mismatching related to acoustic characteristics such as frequency characteristics and phases can be suppressed.

FIG. 8A is a plan view showing a partially cutaway microphone 41 in which the acoustic sensor 11 according to the first embodiment is built, and shows an inside of the microphone by removing the upper surface of a cover 43. FIG. 8B is a vertical sectional view of the microphone 41.

The microphone 41 is configured such that the acoustic sensor 11 and a signal processing circuit 44 (ASIC) are built in a package configured by a circuit board 42 and a cover 43. The acoustic sensor 11 and the signal processing circuit 44 are mounted on the upper surface of the circuit board 42. In the circuit board 42, a sound introduction hole 45 to guide acoustic vibration into the acoustic sensor 11 is formed. The acoustic sensor 11 is mounted on the upper surface of the circuit board 42 to align the lower opening of the chamber 15 to the sound introduction hole 45 and to cover the sound introduction hole 45. Thus, the chamber 15 of the acoustic sensor 11 serves as a front chamber, and a space in the package serves as a back chamber.

The electrode pads 31, 32*a*, 32*b*, and 33 of the acoustic sensor 11 are connected to pads 47 of the signal processing circuit 44 with bonding wires 46, respectively. A plurality of terminals 48 to electrically connect the microphone 41 to the outside are formed on the lower surface of the circuit board 42, and electrode units 49 electrically connected to the terminals 48 are formed on the upper surface of the circuit board 42. The pads 50 of the signal processing circuit 44 mounted on the circuit board 42 are connected to the electrode units 49 with bonding wires 51, respectively. The pads 50 of the signal processing circuit 44 have a function of supplying a power source to the acoustic sensor 11 and a function of outputting a capacity change signal of the acoustic sensor 11 to the outside.

On the upper surface of the circuit board 42, the cover 43 is attached to cover the acoustic sensor 11 and the signal processing circuit 44. The package has an electromagnetic shielding function to protect the acoustic sensor 11 and the signal processing circuit 44 from electric disturbance or mechanical impact from the outside.

In this manner, acoustic vibration entering the chamber 15 through the sound introduction hole 45 is detected by the acoustic sensor 11, amplified and signal-processed with the signal processing circuit 44, and then output. In the microphone 41, since the space in the package is used as a back chamber, the volume of the back chamber can be increased, and the sensitivity of the microphone 41 can be improved.

In the microphone 41, the sound introduction hole 45 to guide acoustic vibration into the package may be formed on the upper surface of the cover 43. In this case, the chamber 15 of the acoustic sensor 11 serves as a back chamber, and the space in the package serves as a front chamber.

Figure 8:
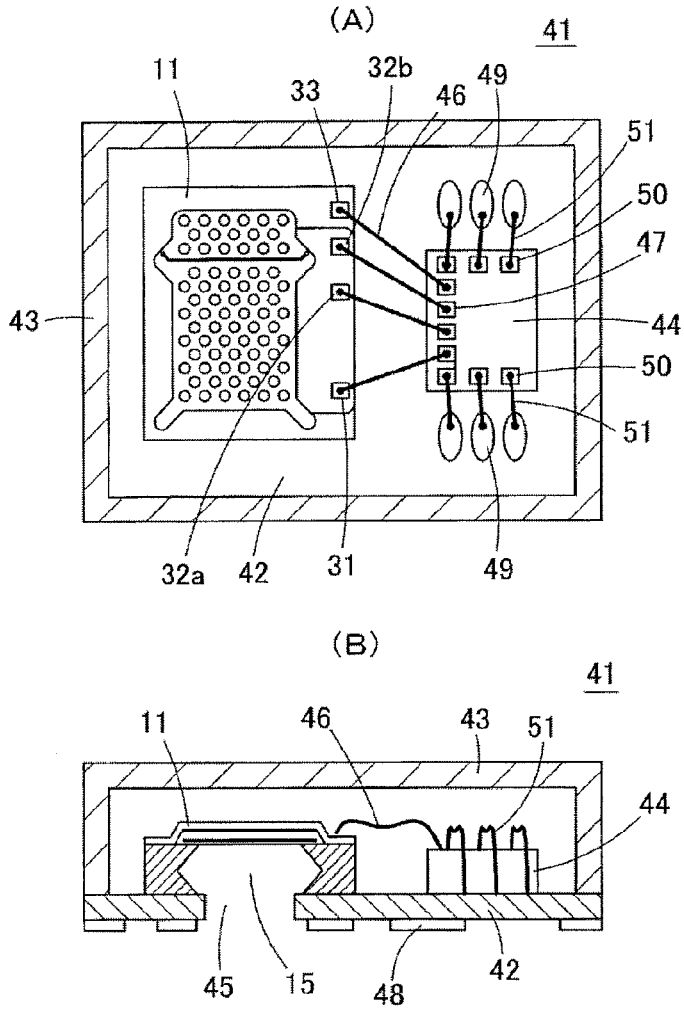
FIG. 8A is a plan view showing a partially cutaway microphone in which the acoustic sensor according to the first embodiment of the present invention and a signal processing circuit are stored in a casing.
FIG. 8B is a vertical sectional view of the microphone.
Figure 9:
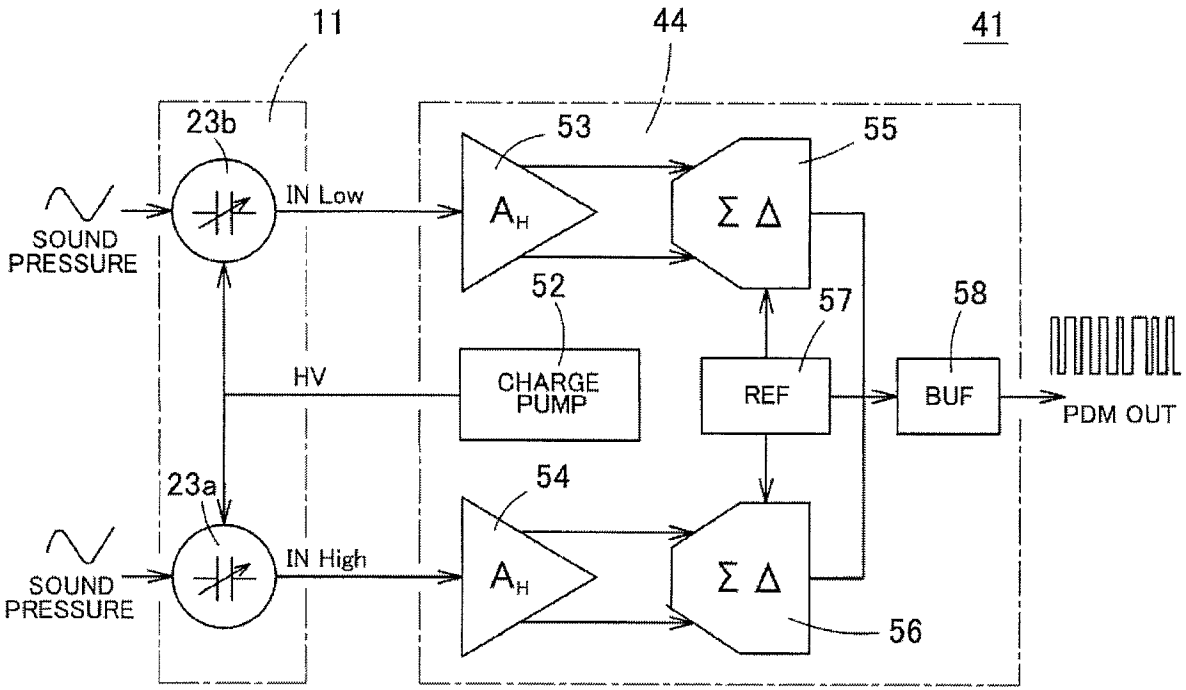
FIG. 9 is a circuit diagram of a microphone according to the first embodiment of the present invention.

FIG. 9 is a circuit diagram of the MEMS microphone 41 shown in FIG. 8. As shown in FIG. 9, the acoustic sensor 11 includes the high-sensitive first acoustic sensing unit 23*a* and the low-sensitive second acoustic sensing unit 23*b* the volumes of which change with acoustic vibration.

The signal processing circuit 44 includes a charge pump 52, an amplifier 53 for low sensitivity, an amplifier 54 for high sensitivity, $\Sigma\Delta(\Delta\Sigma)$-type ADCs (Analog-to-Digital Converters) 55 and 56, a reference voltage generator 57, and a buffer 58.

In the charge pump 52, a high voltage HV is applied to the first acoustic sensing unit 23*a* and the second acoustic sensing unit 23*b*, an electric signal output from the second acoustic sensing unit 23*b* is amplified with the amplifier 53 for low sensitivity, and an electric signal output from the first acoustic sensing unit 23*a* is amplified with the amplifier 54 for high sensitivity. The signal amplified with the amplifier 53 for low sensitivity is converted into a digital signal in the ΣΔ-type ADC 55. Similarly, the signal amplified with the amplifier 54 for high sensitivity is converted into a digital signal in the ΣΔ-type ADC 56. The digital signals converted in the ΣΔ-type ADCs 55 and 56 are output as PDM (pulse density modulation) signals to the outside through the buffer 58. Although not shown, when the signal output from the buffer 58 has a high intensity (more specifically, a high sound pressure), an output from the ΣΔ-type ADC 55 is kept on, and an output from the ΣΔ-type ADC 56 is turned off. Thus, an electric signal of acoustic vibration having a high sound pressure detected with the second acoustic sensing unit 23*b* is output from the buffer 58. In contrast to this, when the signal output from the buffer 58 has a low intensity (more specifically, a low sound pressure), an output from the ΣΔ-type ADC 56 is kept on, and an output from the ΣΔ-type ADC 55 is turned off. Thus, an electric signal of acoustic vibration having a low sound pressure detected with the first acoustic sensing unit 23*a* is output from the buffer 58. In this manner, the first acoustic sensing unit 23*a* and the second acoustic sensing unit 23*b* are automatically switched depending on sound pressures.

In the example in FIG. 9, the two digital signals converted with the ΣΔ-type ADCs 55 and 56 are mixed with each other to output the mixed signal on one data line. However, the two digital signals may be output onto different data lines, respectively.

In the acoustic sensor in which the high-sensitive and low-sensitive acoustic sensing units are arranged or a microphone in which the acoustic sensor is built, interference between the high-sensitive (small-volume side) acoustic sensing unit and the low-sensitive (large-volume side) acoustic sensing unit increases harmonic distortion of the low-sensitive acoustic sensor. As a result, the maximum detection sound pressure of the acoustic sensor may decrease to narrow the dynamic range. According to the acoustic sensor 11 according to the first embodiment of the present invention, the increase in harmonic distortion can be prevented. The reason will be described below.

Figure 10:
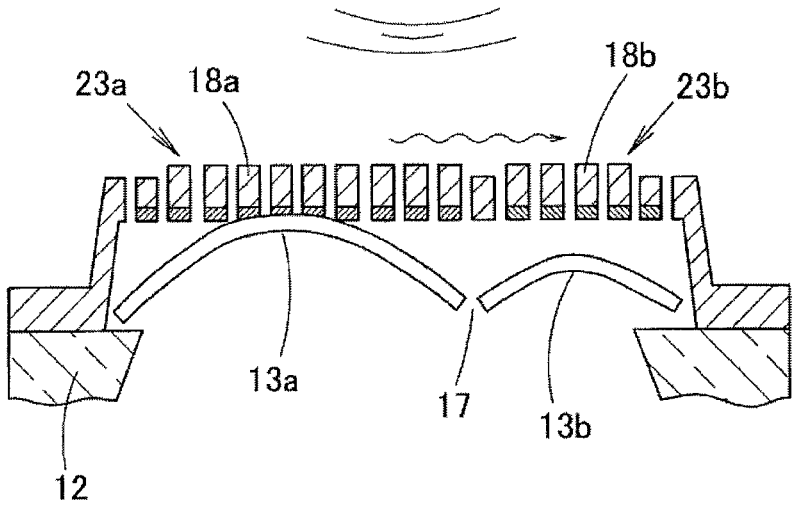
FIG. 10 is a schematic sectional view showing a manner in which a diaphragm on a high-sensitive side collides with a back plate in an acoustic sensor according to a comparative example.

The first diaphragm 13*a* on a high-sensitive side has an area larger than and flexibility more than those of the second diaphragm 13*b* on a low-sensitive side. For this reason, when acoustic vibration having a high sound pressure is applied to the acoustic sensor, as shown in FIG. 10, the first diaphragm 13*a* may collide with the back plate 18*a*. FIG. 10 shows a case in which a high sound pressure causes the first diaphragm 13*a* to collide with the back plate 18*a* in an acoustic sensor according to a comparative example. In the comparative example described here, no back plate slit is formed in the back plate 18, and the back plate 18*a* of the first acoustic sensing unit 23*a* and the back plate 18*b* of the second acoustic sensing unit 23*b* are continuously and integrally formed.

Figure 11:
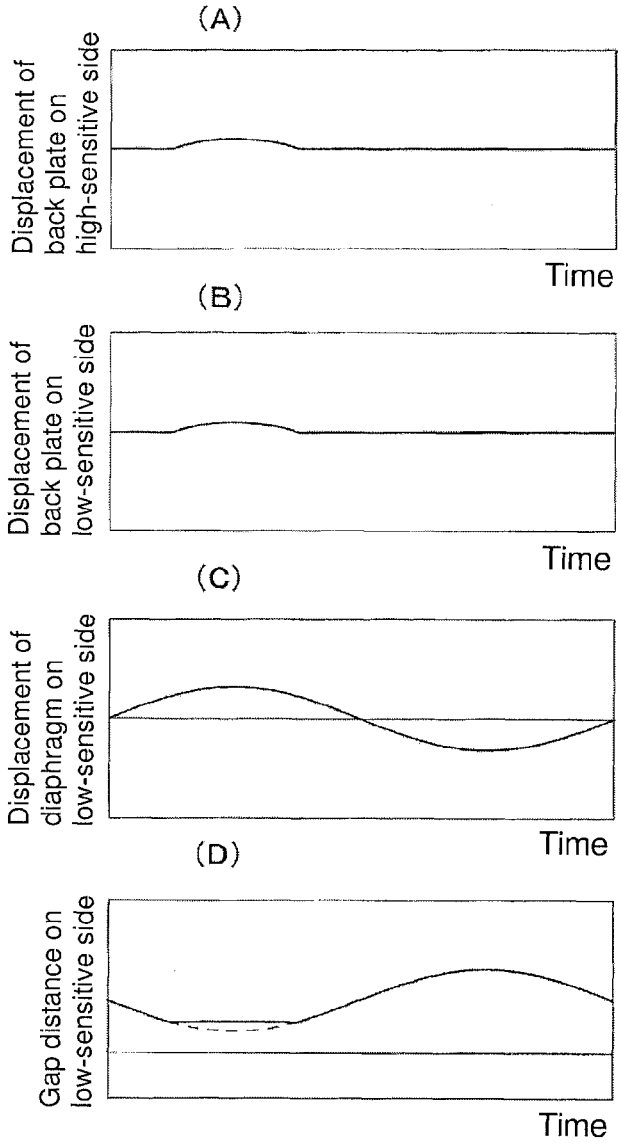
FIG. 11A is a diagram showing vibration generated in a back plate on a high-sensitive side when the diaphragm on the high-sensitive side collides with the back plate in the acoustic sensor in FIG. 10.
FIG. 11B is a diagram showing vibration propagated to a back plate on a low-sensitive side when the diaphragm on the high-sensitive side collides with the back plate in the acoustic sensor in FIG. 10.
FIG. 11C is a diagram showing vibration of a diaphragm on a low-sensitive side.
FIG. 11D is a diagram showing a change of a gap between the diaphragm on the high-sensitive side and the fixed electrode plate when the diaphragm on the high-sensitive side collides with the back plate in the acoustic sensor in FIG. 10.

As shown FIG. 10, when the first diaphragm 13*a* collides with the back plate 18*a*, the impact distorts vibration of the back plate 18*a* to generate distortion vibration as shown in FIG. 11A. Although the back plate vibrates with acoustic vibration like the diaphragm, the amplitude of the back plate is not shown in FIG. 11 because the amplitude is about 1/100 the amplitude of the diaphragm. Since the distortion vibration generated by the back plate 18*a* is transmitted to the back plate 18*b*, the impact of the first diaphragm 13*a* generates distortion vibration also in the back plate 18*b* as shown in FIG. 11B. On the other hand, it is assumed that, since the second diaphragm 13*b* has displacement smaller than that of the first diaphragm 13*a*, the second diaphragm 13*b* sinusoidally vibrates as shown in FIG. 11C without collating with the back plate 18*b*. When the distortion vibration of the back plate 18*b* is added to sinusoidal vibration of the second diaphragm 13*b*, a gap distance between the back plate 18*b* and the second diaphragm 13*b* in the second acoustic sensing unit 23*b* changes as shown in FIG. 11D. As a result, an output signal from the second acoustic sensing unit 23*b* is distorted, and the total harmonic distortion of the second acoustic sensing unit 23*b* is deteriorated.

Figure 12:
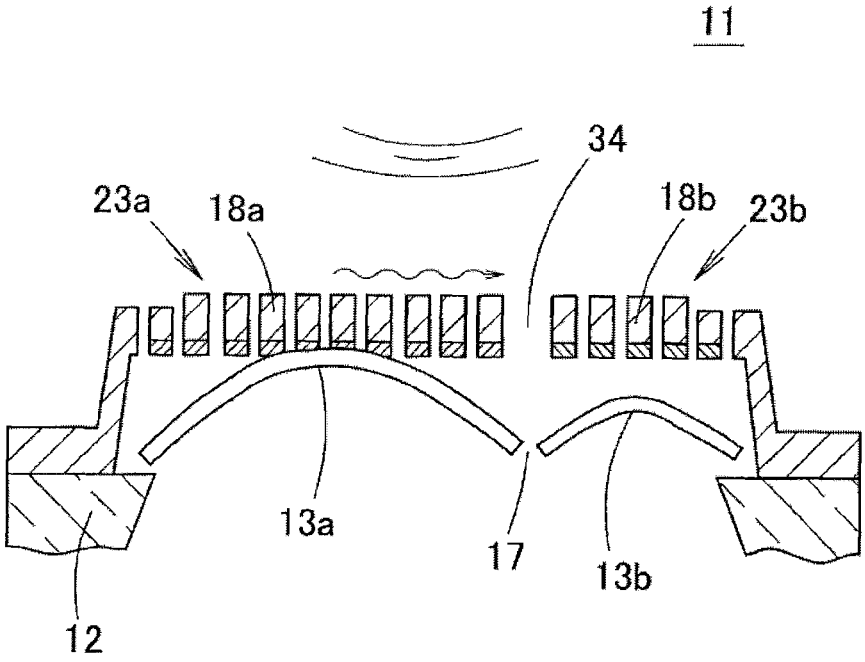
FIG. 12 is a schematic sectional view showing a manner in which a diaphragm on a high-sensitive side collides with a back plate in an acoustic sensor according to a first embodiment of the present invention.
Figure 13:
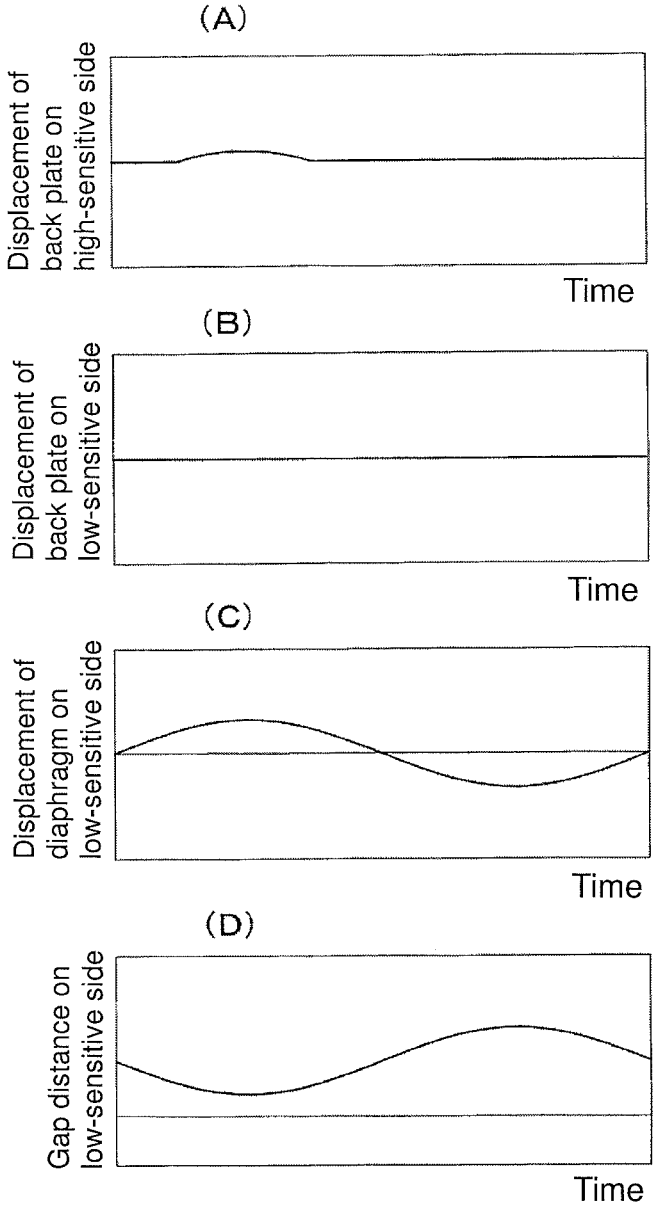
FIG. 13A is a diagram showing vibration generated in a back plate on a high-sensitive side when the diaphragm on the high-sensitive side collides with the back plate in the acoustic sensor in FIG. 12.
FIG. 13B is a diagram showing vibration propagated to a back plate on a low-sensitive side when the diaphragm on the high-sensitive side collides with the back plate in the acoustic sensor in FIG. 12.
FIG. 13C is a diagram showing vibration of a diaphragm on a low-sensitive side.
FIG. 13D is a diagram showing a change of a gap between the diaphragm on the high-sensitive side and the fixed electrode plate when the diaphragm on the high-sensitive side collides with the back plate in the acoustic sensor in FIG. 12.

In contrast to this, in the acoustic sensor 11 according to the first embodiment, as shown in FIG. 12, the back plate 18*a* on a high-sensitive side and the back plate 18*b* on a low-sensitive side are separated from each other by the slit 34. For this reason, even though a high sound pressure causes the first diaphragm 13*a* to collide with the back plate 18*a* to generate distortion vibration as shown in FIG. 13A, the distortion vibration is not easily transmitted to the back plate 18*b* over the slit 34 as shown in FIG. 13B. As a result, when a vibration waveform of the first diaphragm 13*a* by acoustic vibration is as shown in FIG. 13C, a gap distance between the second diaphragm 13*b* and the back plate 18*b* has the same waveform as shown in FIG. 11D. Thus, even though distortion vibration is generated in the first acoustic sensing unit 23*a*, the distortion vibration is not easily transmitted to the second acoustic sensing unit 23*b*, and a signal output from the second acoustic sensing unit 23*b* does not easily include distortion. For this reason, the total harmonic distortion of the second acoustic sensing unit 23*b* is not easily deteriorated. As a result, the dynamic range of the acoustic sensor 11 can be prevented from being narrowed by the distortion vibration in the first acoustic sensing unit 23*a*.

When a length L2 of the slit 34 is smaller than a width L1 of the fixed electrode plate 19, an effect of blocking distortion vibration can be obtained. However, in order to sufficiently separate vibration on the first acoustic sensing unit 23*a* side from vibration on the second acoustic sensing unit 23*b* side to sufficiently block the second electrode pad 32*b* from distortion vibration, as shown in FIG. 6, the length L2 of the slit 34 is desirably larger than the width L1 of the fixed electrode plate 19. As the size of the acoustic sensor 11, a length of 1.6 mm, a width of 1.35 mm, and a thickness of 0.4 mm are given, and the width L1 of the fixed electrode plate 19 is about 700 μm. For this reason, the length L2 of the slit 34 is desirably 700 μm or more. According to one or more embodiments of present invention, the width W of the slit 34 is about 4 μm or more and 10 μm or less in consideration of processing accuracy of the back plate slit by the MEMS process, space saving, prevention of collision between facing wall surfaces of the back plate slit, and the like.

The slit 34 is desirably located immediately over the slit 17 of the diaphragm 13. A position near the slit 17 of the diaphragm 13 is a position where a displacement amount of the diaphragm 13 is large. Thus, since the position near the slit 17 of the diaphragm 13 is a boundary between a position (first diaphragm 13*a*) where the diaphragm 13 easily collides with the back plate 18 and a position (second diaphragm 13*b*) where the diaphragm 13 does not easily collides with the back plate 18, according to one or more embodiments of present invention, the back plate slit 34 is arranged immediately over the boundary to block vibration including distortion from being transmitted. When the slit 17 is formed in the diaphragm 13, the difference of the sensitivities of the first acoustic sensing unit 23*a* and the second acoustic sensing unit 23*b* can be advantageously increased. Thus, according to one or more embodiments of present invention, the slit 17 of the diaphragm 13 is defined as the boundary between the acoustic sensing units 23*a* and 23*b* in terms of characteristics, and the slit 34 of the back plate 18 is desirably aligned to the slit 17.

In each of the back plates 18 of models I to IV, a pressure of 200 Pa was applied to the back plate 18*a* on a high-sensitive side, displacements generated in the back plate 18*a* and the back plate 18*b* at this time were calculated by simulation, and it was evaluated whether the displacement on the back plate 18*a* side was transmitted to the back plate 18*b* side. In applied model I, the fixed electrode plates 19*a* and 19*b* each having a width of about 700 μm and the back plate 18 having a large number of acoustic holes 24 each having a diameter of 17 μm were used, and no slit 34 was present. In model II, the fixed electrode plates 19*a* and 19*b* each having a width of about 700 μm and the back plate 18 having a large number of acoustic holes 24 each having a diameter of 17 μm were used, and the slit 34 having a length of 320 μm was present. In model III, the fixed electrode plates 19*a* and 19*b* each having a width of about 700 μm and the back plate 18 having a large number of acoustic holes 24 each having a diameter of 17 μm were used, and the slit 34 having a length of 540 μm was present. In model IV, the fixed electrode plates 19*a* and 19*b* each having a width of about 700 μm and the back plate 18 having a large number of acoustic holes 24 each having a diameter of 17 μm were used, and the slit 34 having a length of 720 μm was present.

Figure 16:
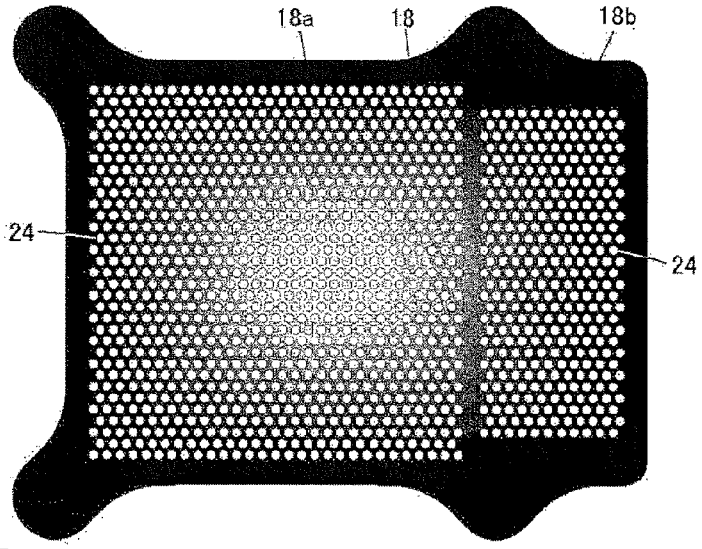
FIG. 16 is a diagram showing a distribution of displacement amounts in a pressure application state in a model I in which a slit for back plate is not formed in the back plate.
Figure 17:
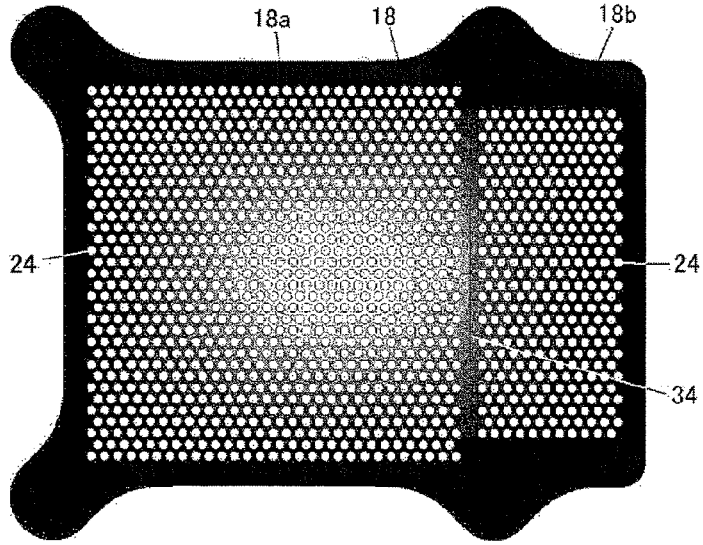
FIG. 17 is a diagram showing a distribution of displacement amounts in a pressure application state in a model II in which a slit for back plate having a length of 320 μm is formed in the back plate.
Figure 18:
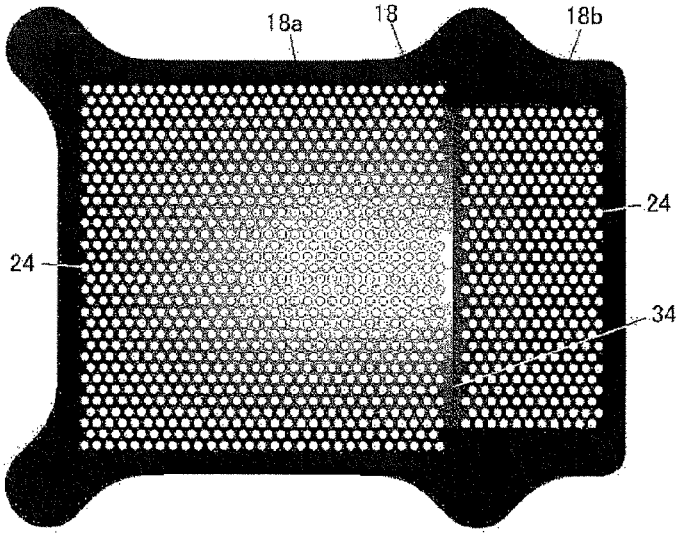
FIG. 18 is a diagram showing a distribution of displacement amounts in a pressure application state in a model III in which a slit for back plate having a length of 540 μm is formed in the back plate.
Figure 19:
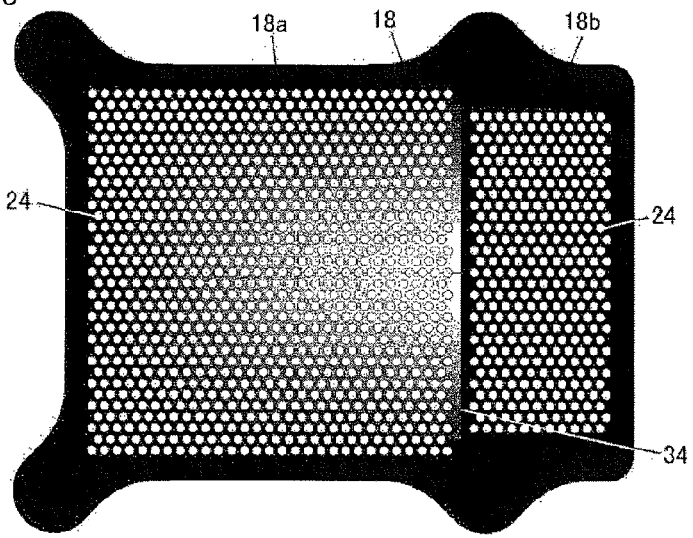
FIG. 19 is a diagram showing a distribution of displacement amounts in a pressure application state in a model IV in which a slit for back plate having a length of 720 μm is formed in the back plate.

Each of FIG. 16 to FIG. 19 shows displacements in the back plates 18*a* and 18*b* when a pressure of 200 Pa is applied to the back plate 18*a* depending on densities of black and white colors. In each of the drawings, a displacement is zero in a black region, and the whiter the color is, the larger a displacement amount is. FIG. 16 shows a case using the back plate 18 in model I. FIG. 17 shows a case using the back plate 18 in model II. FIG. 18 shows a case using the back plate 18 in model III. FIG. 19 shows a case using the back plate 18 in model IV. As is apparent from comparison between FIG. 16 to FIG. 19, when the slit 34 increases in length, a position where the maximum displacement occurs in the back plate 18 gradually moves to the slit 34 side, and the displacement of the back plate 18*b* gradually decreases. In particular, as shown in FIG. 19, when the length of the slit 34 is larger than the widths of the diaphragms 13*a* and 13*b*, displacement rarely occurs in the back plate 18*b*.

Figure 14:
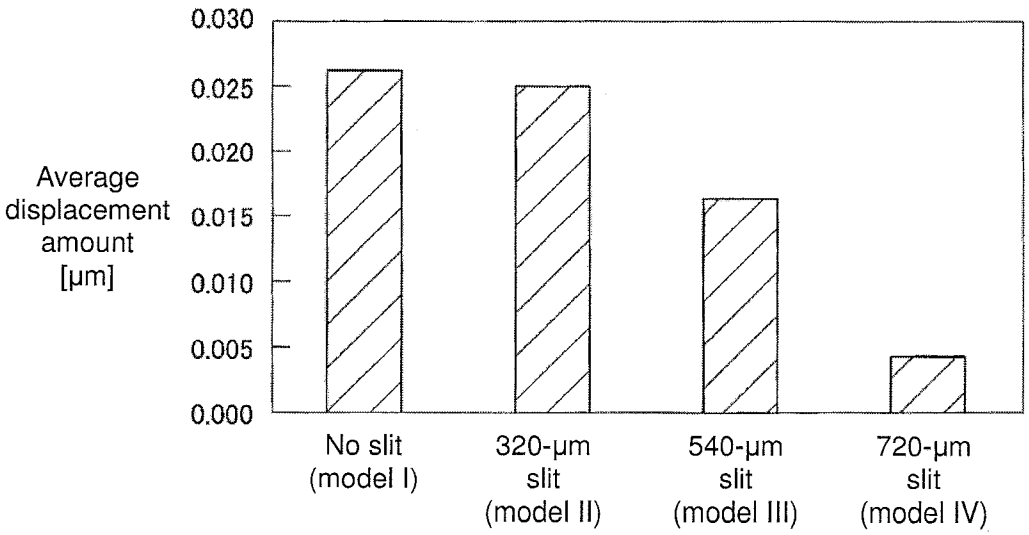
FIG. 14 is a diagram showing a relationship between a length of a slit for back plate formed in the back plate and an average displacement amount of a diaphragm.

FIG. 14 is a diagram showing comparison between average displacement amounts of the back plates 18*b* on a low-sensitive side in the models shown in FIG. 16 to FIG. 19. As is apparent from FIG. 14, in comparison with the case in which no slit 34 is arranged, when the slit 34 having a length of 720 μm is arranged, the average displacement amount of the back plate 18*b* decreases by 82%, an advantage by the slit 34 is enhanced.

Figure 15:
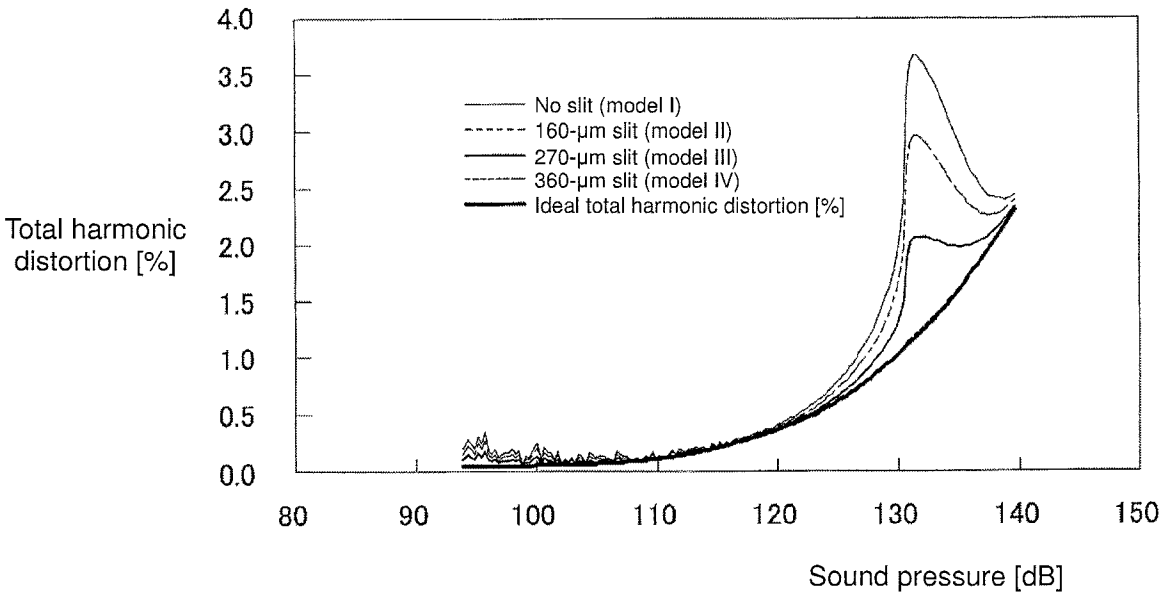
FIG. 15 is a diagram showing a relationship between the length of the slit of the back plate and a total harmonic distortion of a low-sensitive acoustic sensing unit.

FIG. 15 shows a result obtained by calculating total harmonic distortions of the acoustic sensors included in the back plates 18 in models I to IV by simulation. Referring to FIG. 15, large harmonic distortion occurs in a region having a high sound pressure. The harmonic distortion in the high-sound-pressure region is maximum in model I having no slit, and the total harmonic distortions decrease when the lengths of the slits 34 increase as in models II, III, and IV. In particular, a curve in model IV is approximate to a curve of an ideal total harmonic distortion. In this case, the ideal total harmonic distortion is a total harmonic distortion obtained when distortion vibration is not propagated from the back plate 18*a* to the back plate 18*b* through the back plate 18.

The slit 34 achieves not only improvement of a total harmonic distortion but also the following operational effect. When air between the diaphragms 13*a* and 13*b* and the fixed electrode plates 19*a* and 19*b* is confined in the gap, fluctuation (thermal agitation of air molecules) of air generates thermal noise to reduce an S/N ratio of a signal. In contrast to this, when the slit 34 is formed in the back plate 18, the air molecules in the gap can be escaped from the slit 34 to the outside. For this reason, noise caused by thermal noise is reduced.

When no slit 34 is formed, a part of the back plate 18 made of SiN is located between the first fixed electrode plate 19*a* and the second fixed electrode plate 19*b*. When the slit 34 is formed, a material between the fixed electrode plates 19*a* and 19*b* becomes air to reduce a dielectric constant. For this reason, when the slit 34 is formed, a parasitic capacitance between the fixed electrode plates 19*a* and 19*b* decreases, and the sensitivity of the acoustic sensor 11 is improved.

In the acoustic sensor 11 according to the first embodiment, as shown in FIGS. 6A and 6B, at an end of the slit 34, a circular notch 35 having a diameter larger than the width W of the slit 34 is formed. For this reason, stress concentration caused by residual stress and dropping impact occurring at an end portion of the slit 34 in the manufacturing process of the acoustic sensor 11 is moderated, and the back plate 18 can be prevented from being damaged.

Figure 20:
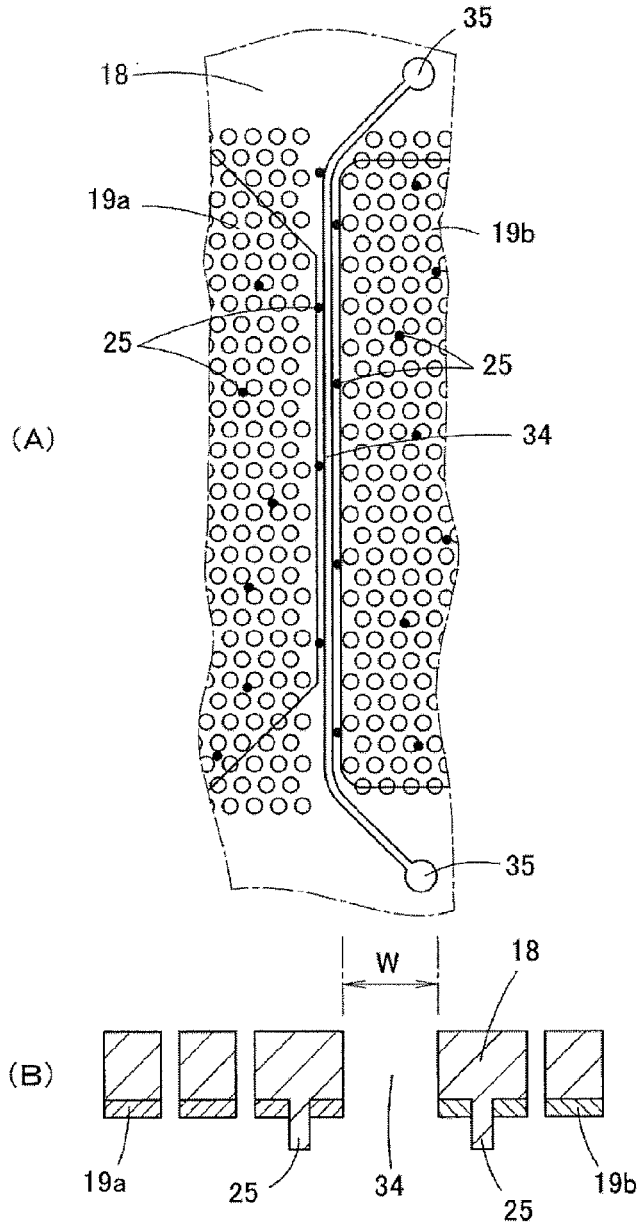
FIG. 20A is a bottom view showing stoppers formed at an edge of a slit of a back plate.
FIG. 20B is a sectional view of the back plate showing the stoppers formed at the edge of the slit of the back plate.

In the acoustic sensor 11 according to the first embodiment, as shown in FIGS. 20A and 20B, stoppers 25 are projected from the lower surface of the back plate 18 along an edge of the slit 34. When the slit 34 is formed in the back plate 18, the periphery of the slit 34 is easily bent. For this reason, the back plate 18 and the diaphragms 13*a* and 13*b* which are easily bent are easily stuck (fixed) to each other. For this reason, the stoppers 25 are formed along the edge of the slit 34 to prevent the back plate 18 and the diaphragms 13*a* and 13*b* from being stuck to each other.

Modification of First Embodiment

Figure 21:
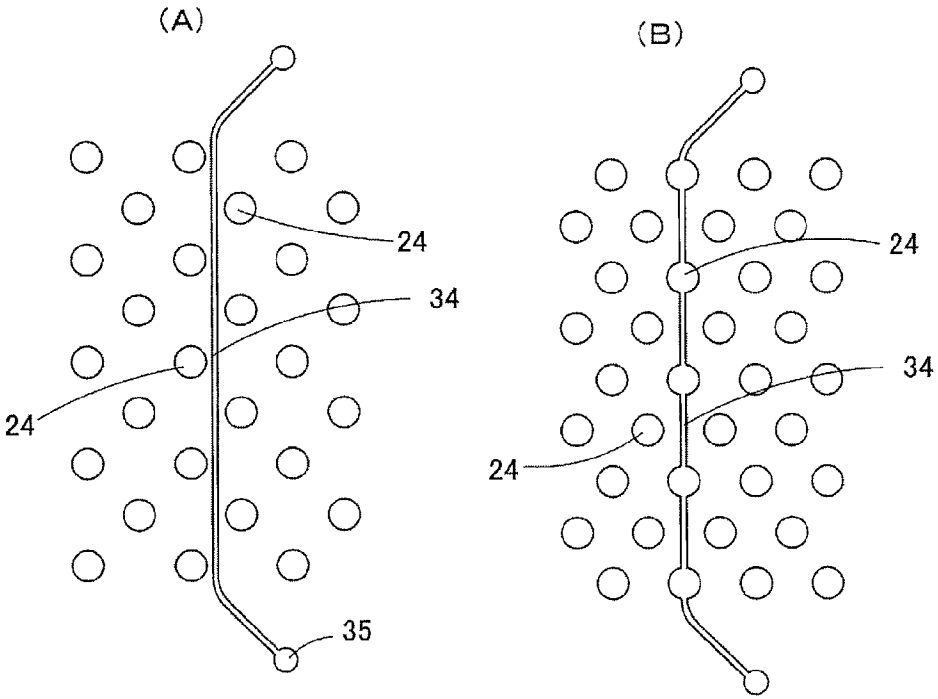
FIGS. 21A and 21B are diagrams showing various modes of the slit of the back plate.
Figure 22:
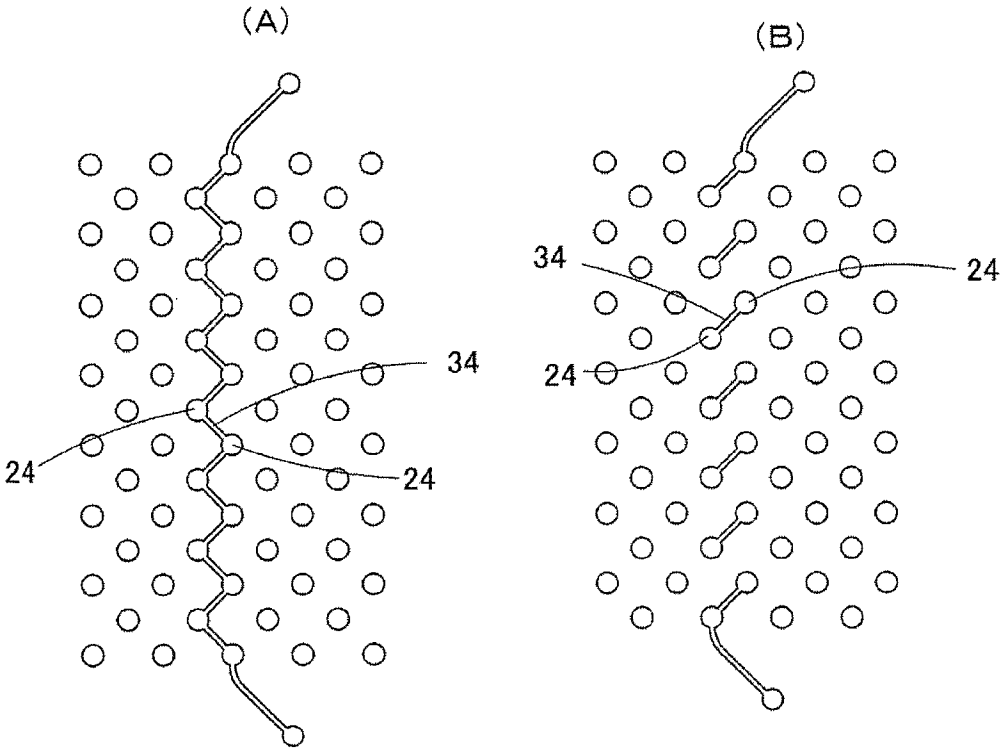
FIGS. 22A and 22B are diagrams showing various modes of the slit of the back plate.

FIGS. 21A, 21B, 22A, and 22B show various modes of the slit 34. FIG. 21A shows a case in which the nearly straight slit 34 is formed to avoid the acoustic holes 24. According to this mode, the slit 34 can be formed while the acoustic holes 24 are maintained in a conventional arrangement. FIG. 21B shows a case in which the straight slit 34 is formed by using the acoustic holes 24. According to the mode, an area for arranging the slit 34 can be saved to achieve space saving. FIG. 22A shows a case in which the zigzag slit 34 is formed by using the acoustic holes 24. According to the mode, an area for arranging the slit 34 can be saved to achieve space saving. FIG. 22B shows a case in which the plurality of inclined slits 34 are sectionally formed by using the acoustic holes 24. According to this mode, while the rigidity of the back plate 18 near the slit 34 is maintained, interference caused between the acoustic sensing units 23*a* and 23*b* by vibration of the back plate 18 can be reduced, and harmonic distortion can be suppressed.

Second Embodiment

Figure 23:
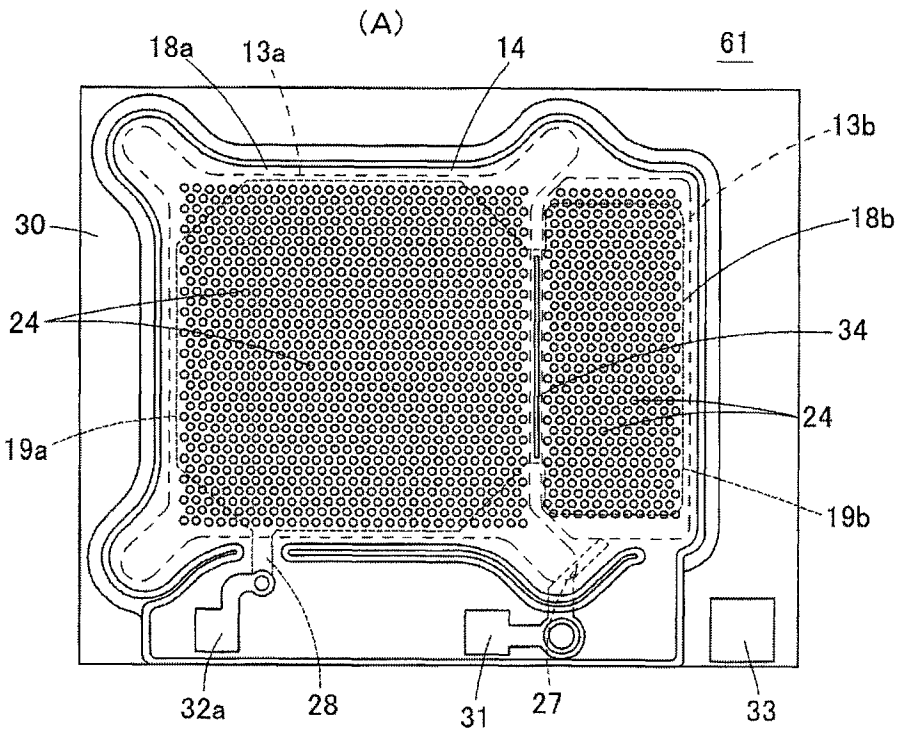
FIG. 23 is a plan view of an acoustic sensor according to a second embodiment of the present invention.
Figure 24:
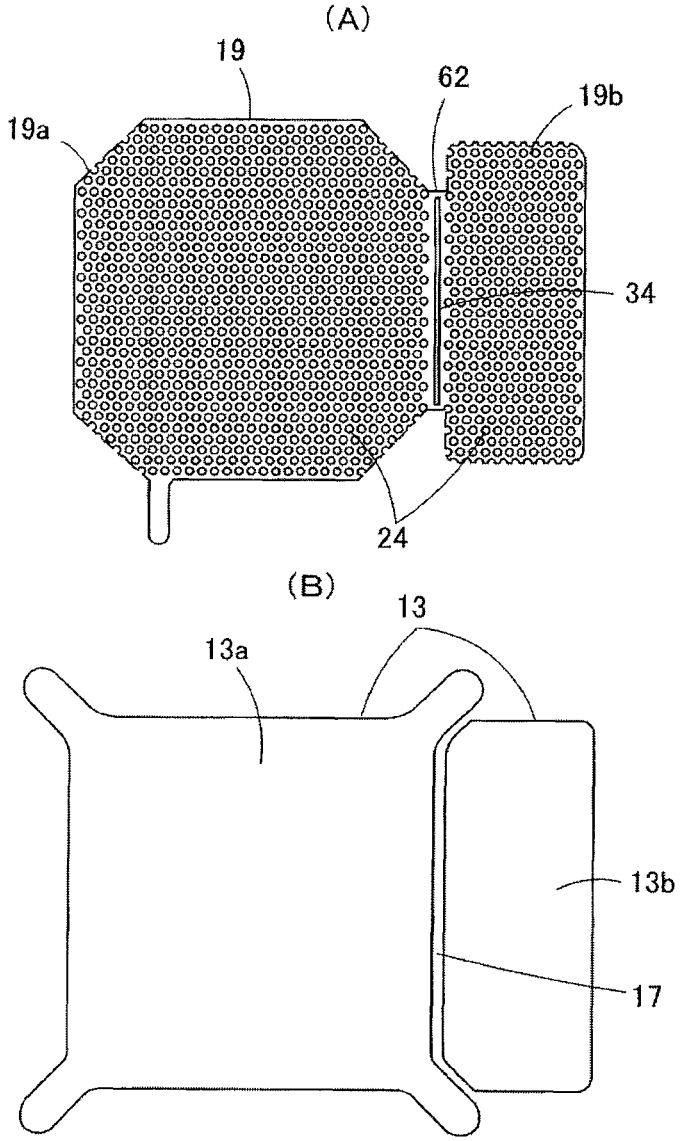
FIG. 24A is a plan view showing a fixed electrode plate in the acoustic sensor in FIG. 23.
FIG. 24B is a plan view showing a diaphragm in the acoustic sensor in FIG. 23.

FIG. 23 is a plan view of an acoustic sensor 61 according to a second embodiment of the present invention. FIG. 24A is a plan view showing the fixed electrode plate 19 of the acoustic sensor 61. FIG. 24B is a plan view showing the diaphragms 13*a* and 13*b* of the acoustic sensor 61.

In the acoustic sensor 61 according to the second embodiment, as shown in FIG. 24B, the diaphragm 13 is completely divided by the slit 17 into two regions, i.e., the first diaphragm 13*a* and the second diaphragm 13*b*. On the other hand, as shown in FIG. 24A, the first fixed electrode plate 19*a* and the second fixed electrode plate 19*b* are integrally connected to each other by a connection unit 62. In the connection unit 62 between the back plate 18 and the fixed electrode plate 19, as shown in FIG. 23 and FIG. 24A, the slit 34 having a length smaller than the width of the connection unit 62 is formed. The other structure is the same as that in the first embodiment of the present invention, and a description thereof will be omitted.

Even in the acoustic sensor 61 according to the second embodiment, as in the first embodiment, a total harmonic distortion in the second acoustic sensing unit 23*b* can be reduced. An effect of reducing thermal noise and an effect of reducing a parasitic capacitance are also achieved.

Third Embodiment

Figure 25:
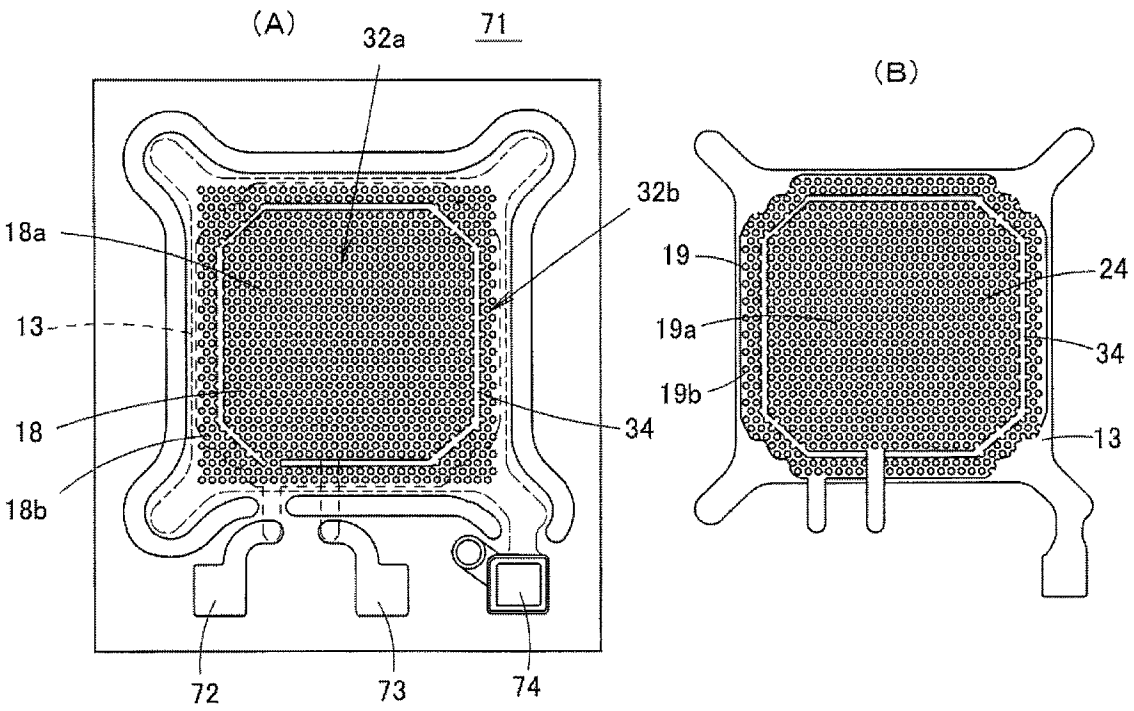
FIG. 25A is a plan view of the acoustic sensor according to a third embodiment of the present invention.
FIG. 25B is a plan view showing a fixed electrode plate and a diaphragm in an acoustic sensor according to the third embodiment.

FIG. 25A is a plan view of an acoustic sensor 71 according to a third embodiment of the present invention. FIG. 25B is a plan view showing the fixed electrode plates 19*a* and 19*b* and the diaphragm 13 in the acoustic sensor 71.

In the acoustic sensor 71 according to the third embodiment, the nearly rectangular diaphragm 13 is used. The diaphragm 13 is integrally formed, and does not include the slit 17 unlike in the first embodiment. The fixed electrode plate 19 arranged on the lower surface of the back plate 18, as shown in FIG. 25B, is completely divided into the second fixed electrode plate 19*b* that is an outer peripheral portion and the first fixed electrode plate 19*a* formed inside the second fixed electrode plate 19*b*. Thus, the diaphragm 13 and the first fixed electrode plate 19*a* configure the first acoustic sensing unit 23*a*, and the diaphragm 13 and the second fixed electrode plate 19*b* configure the second acoustic sensing unit 23*b*. The first fixed electrode plate 19*a* has an area sufficiently larger than that of the second fixed electrode plate 19*b*, the first acoustic sensing unit 23*a* serves as a high-sensitive sensing unit for a small volume, and the second acoustic sensing unit 23*b* serves as a low-sensitive sensing unit for a large volume. In the back plate 18, as shown in FIG. 25A, the back plate slit 34 is formed along a boundary portion between the first fixed electrode plate 19*a* and the second fixed electrode plate 19*b* to divide the back plate 18 into the back plate 18*a* and the back plate 18*b*. Since the slit 34 has a nearly annular shape (partially cut annular shape) and vertically penetrates the back plate 18, the back plate 18*a* and the back plate 18*b* are connected to each other at one position.

An electrode pad 72 shown in FIG. 25A is electrically connected to the second fixed electrode plate 19*b*. An electrode pad 73 is electrically connected to the first fixed electrode plate 19*a*. An electrode pad 74 is electrically connected to the diaphragm 13.

Even in the acoustic sensor 71, when acoustic vibration having a large volume (high sound pressure) is applied, the displaced diaphragm 13 may collide with the first fixed electrode plate 19*a* inside the diaphragm 13. When the diaphragm 13 collides with the first fixed electrode plate 19*a*, distortion vibration may be transmitted from the first acoustic sensing unit 23*a* on a high-sensitivity side to the second acoustic sensing unit 23*b* on a low-sensitive side. However, even in the acoustic sensor 71, since the first acoustic sensing unit 23*a* and the second acoustic sensing unit 23*b* are divided by forming the slit 34 in the back plate 18, distortion vibration can be prevented from being transmitted from the first acoustic sensing unit 23*a* to the second acoustic sensing unit 23*b*, and a total harmonic distortion of the second acoustic sensing unit 23*b* can be suppressed from increasing.

Modification of Third Embodiment

Figure 26:
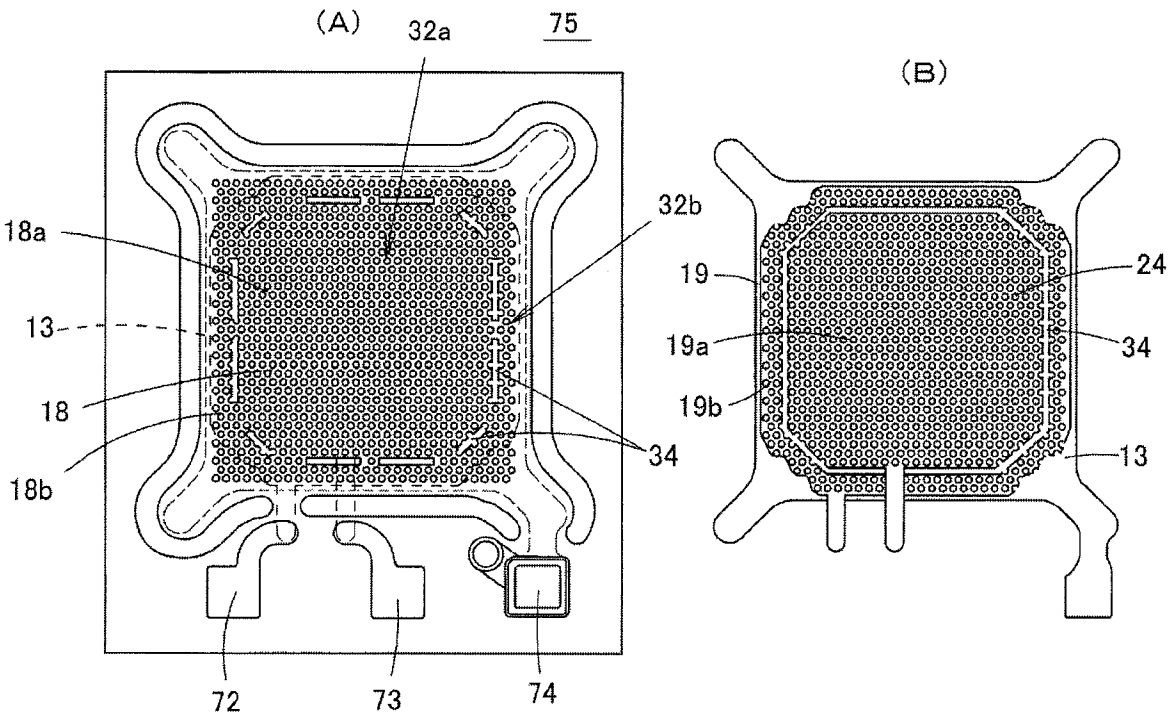
FIG. 26A is a plan view of an acoustic sensor according to a modification of the third embodiment of the present invention.
FIG. 26B is a plan view showing a fixed electrode plate and a diaphragm in the acoustic sensor according to the modification of the third embodiment.

FIG. 26A is a plan view of an acoustic sensor 75 according to a modification of the third embodiment of the present invention. FIG. 26B is a plan view showing the fixed electrode plates 19*a* and 19*b* and the diaphragm 13 in the acoustic sensor 75.

In the acoustic sensor 71 according to the third embodiment, the back plate 18*a* and the back plate 18*b* are partially connected to each other, and the slit 34 is formed in a nearly annular shape. For this reason, the internal back plate 18*a* may be unstably supported by the back plate 18*b* because the back plate 18*a* is cantilevered by the back plate 18*b*.

In this case, as shown in FIG. 26A, the short slits 34 may be intermittently formed in the back plate 18 to support the back plate 18*a* at arbitrary intervals.

The back plate 18*a* and the back plate 18*b* may be connected to each other at 2 to 4 positions.

Figure 27:
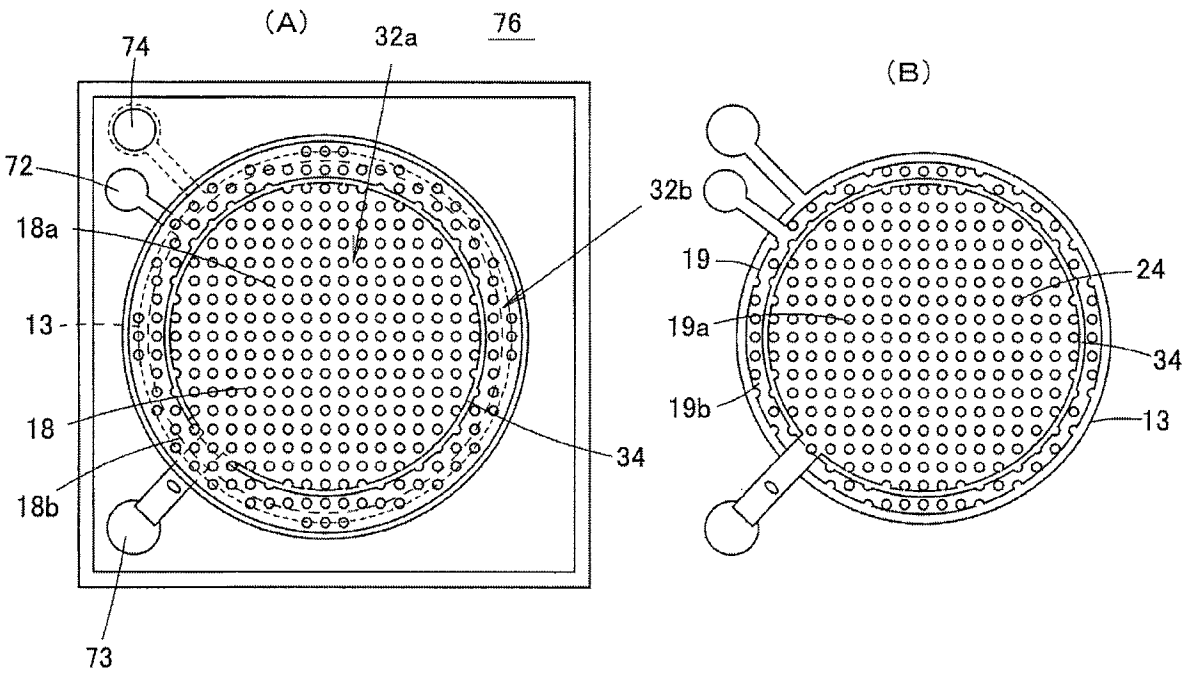
FIG. 27A is a plan view showing an acoustic sensor according to another modification of the third embodiment of the present invention.
FIG. 27B is a plan view showing a fixed electrode plate and a diaphragm in the acoustic sensor according to another modification of the third embodiment.

FIG. 27A is a plan view of an acoustic sensor 76 according to another modification of the third embodiment of the present invention. FIG. 27B is a plan view showing the fixed electrode plates 19*a* and 19*b* and the diaphragm 13 in the acoustic sensor 76. This structure is obtained by applying the configuration of the third embodiment to the acoustic sensor 76 having the circular diaphragm 13.

Fourth Embodiment

Figure 28:
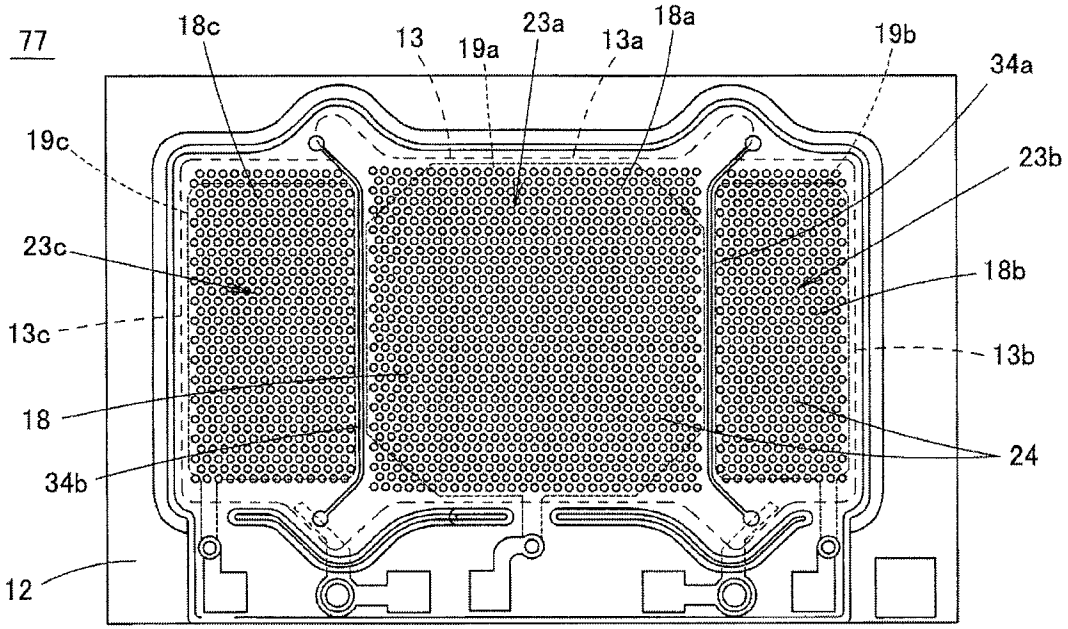
FIG. 28 is a plan view of an acoustic sensor according to a fourth embodiment of the present invention.

FIG. 28 is a plan view showing a structure of an acoustic sensor 77 according to a fourth embodiment of the present invention. The acoustic sensor 77 has three acoustic sensing units 23*a*, 23*b*, and 23*c*. The first acoustic sensing unit 23*a* has a capacitor structure configured by the diaphragm 13*a* and the fixed electrode plate 19*a*, and is a high-sensitive sensing unit for a small volume. The second acoustic sensing unit 23*b* has a capacitor structure configured by the diaphragm 13*b* and the fixed electrode plate 19*b*, and is a low-sensitive sensing unit for a large volume. The third acoustic sensing unit 23*c* has a capacitor structure configured by the diaphragm 13*c* and the fixed electrode plate 19*c*, and is an intermediate-sensitive sensing unit for an intermediate volume.

In the acoustic sensor 77, the diaphragm 13 having a nearly rectangular shape is arranged above the chamber 15 of the silicon substrate 12. The diaphragm 13 is divided by two slits (not shown) into the first diaphragm 13*a* having a nearly rectangular shape and the second diaphragm 13*b* and the third diaphragm 13*c* having a nearly rectangular shape which are located on both the sides of the first diaphragm 13*a*. The third diaphragm 13*c* has an area smaller than the area of the first diaphragm 13*a*. Furthermore, the second diaphragm 13*b* has an area smaller than the area of the third diaphragm 13*c*. The first fixed electrode plate 19*a* is arranged to face the first diaphragm 13*a*. Similarly, the second fixed electrode plate 19*b* is arranged to face the second diaphragm 13*b*. The third fixed electrode plate 19*c* faces the third diaphragm 13*c*. The fixed electrode plates 19*a*, 19*b*, and 19*c* are separated from each other and arranged on the lower surface of the back plate 18 fixed to the upper surface of the silicon substrate 12 to cover the diaphragm 13.

In the back plate 18, a back plate slit 34*a* is formed to pass between the first fixed electrode plate 19*a* and the second fixed electrode plate 19*b*, and a back plate slit 34*b* is formed to pass between the first fixed electrode plate 19*a* and the third fixed electrode plate 19*c*. As a result, the back plate 18 is divided by the slits 34*a* and 34*b* into the back plate 18*a* located in the first acoustic sensing unit 23*a*, the back plate 18*b* located in the second acoustic sensing unit 23*b*, and the back plate 18*c* located in the third acoustic sensing unit 23*c*. The back plates achieve high independence of each other to make vibration difficult to be transmitted between the back plates. In the acoustic sensing units 23*a*, 23*b*, and 23*c*, the acoustic holes 24 are formed in the back plates 18*a*, 18*b*, and 18*c*, and the fixed electrode plates 19*a*, 19*b*, and 19*c*, respectively.

When 3 (or 3 or more) acoustic sensing units are arranged as in the acoustic sensor 77, 3 (or 3 or more) detection signals can be output from one acoustic sensor 77, the dynamic range of the acoustic sensor 77 can be further widened, and an S/N ratio in each sound range can be increased. Distortion vibration generated in the first acoustic sensing unit 23*a* is not easily propagated to the second acoustic sensing unit 23*b* and the third acoustic sensing unit 23*c* through the back plate 18, and acoustic distortion ratios of the acoustic sensing units 23*b* and 23*c* decrease.

(Other)

In one or more of the above embodiments, the area of the first diaphragm 13*a* is made different from the area of the second diaphragm 13*b* to make the displacement amounts of the diaphragms 13*a* and 13*b* different from each other when equal sound pressures are applied to the diaphragms, thereby making the sensitivities of the first acoustic sensing unit 23*a* and the second acoustic sensing unit 23*b* different from each other. In addition, for example, the film thickness of the second diaphragm 13*b* may be made larger than the film thickness of the first diaphragm 13*a* to decrease displacement of the second diaphragm 13*b* and to reduce the sensitivity of the second acoustic sensing unit 23*b* in advance. In addition, for example, the fixed pitch of the second diaphragms 13*b* may be made smaller than the fixed pitch of the first diaphragms 13*a* to decrease displacement of the second diaphragm 13*b* and to reduce the sensitivity of the second acoustic sensing unit 23*b*. Furthermore, the first diaphragm 13*a* may be supported with a beam structure to increase displacement of the first diaphragm 13*a* and to improve the sensitivity of the first acoustic sensing unit 23*a*.

As the isolation portion, an isolation portion made of a material to cause the back plate 18 damp vibration, a material that has a mass larger than that of the material of the back plate 18 or that is softer than the material of the back plate 18 may be used.

Although an acoustic sensor and a microphone using the acoustic sensor have been described above, one or more embodiments of the present invention can also be applied to an electrostatic capacitance sensor except for an acoustic sensor such as a pressure sensor.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

11, 61, 71, 75-77 acoustic sensor
12 silicon substrate
13 diaphragm
13*a* first diaphragm
13*b* second diaphragm
13*c* third diaphragm
17 slit
18, 18*a*, 18*b*, and 18*c* back plate
19 fixed electrode plate
19*a* first fixed electrode plate
19*b* second fixed electrode plate
19*c* third fixed electrode plate
23*a* first acoustic sensing unit
23*b* second acoustic sensing unit
23*c* third acoustic sensing unit
24 acoustic hole
25 stopper
34, 34*a*, 34*b* back plate slit
35 notch
41 microphone
42 circuit board
43 cover
44 signal processing circuit
45 sound introduction hole

The invention claimed is:

1. A capacitance sensor comprising:
a substrate;
a vibration electrode plate formed over an upper side of the substrate;
a back plate formed over the upper side of the substrate to cover the vibration electrode plate; and
a fixed electrode plate arranged on the back plate facing the vibration electrode plate,
wherein at least one of the vibration electrode plate and the fixed electrode plate is divided into a plurality of regions,
wherein a sensing unit configured by the vibration electrode plate and the fixed electrode plate is formed on each of the divided regions, and
wherein an isolation portion that suppresses vibration from being propagated is formed on the back plate to partition the sensing units from each other.

2. The capacitance sensor according to claim 1, wherein the isolation portion is one or more slits formed in the back plate.

3. The capacitance sensor according to claim 2, wherein the slit of the back plate penetrates the back plate from an upper surface to a lower surface of the back plate.

4. An acoustic sensor using the capacitance sensor according to claim 3,
wherein a plurality of holes to cause acoustic vibration to pass are formed in the back plate and the fixed electrode plate, and
wherein the sensing unit outputs a signal by a change in electrostatic capacitance between the diaphragm and the fixed electrode plate that respond to the acoustic vibration.

5. The capacitance sensor according to claim 2, wherein a notch is formed at an end of the slit of the back plate.

6. The capacitance sensor according to claim 5, wherein the diameter of the notch is larger than the width of the slit of the back plate.

7. An acoustic sensor using the capacitance sensor according to claim 6,
wherein a plurality of holes to cause acoustic vibration to pass are formed in the back plate and the fixed electrode plate, and
wherein the sensing unit outputs a signal by a change in electrostatic capacitance between the diaphragm and the fixed electrode plate that respond to the acoustic vibration.

8. An acoustic sensor using the capacitance sensor according to claim 5,
wherein a plurality of holes to cause acoustic vibration to pass are formed in the back plate and the fixed electrode plate, and
wherein the sensing unit outputs a signal by a change in electrostatic capacitance between the diaphragm and the fixed electrode plate that respond to the acoustic vibration.

9. The capacitance sensor according to claim 2, wherein a plurality of holes are formed in the back plate and the fixed electrode plate, and wherein a slit of the back plate straight extends to avoid the holes.

10. An acoustic sensor using the capacitance sensor according to claim 9, wherein a plurality of holes to cause acoustic vibration to pass are formed in the back plate and the fixed electrode plate, and wherein the sensing unit outputs a signal by a change in electrostatic capacitance between the diaphragm and the fixed electrode plate that respond to the acoustic vibration.

11. The capacitance sensor according to claim 2, wherein a plurality of holes are formed in the back plate and the fixed electrode plate, and wherein a slit of the back plate passes through the holes and extends straight.

12. An acoustic sensor using the capacitance sensor according to claim 11, wherein a plurality of holes to cause acoustic vibration to pass are formed in the back plate and the fixed electrode plate, and wherein the sensing unit outputs a signal by a change in electrostatic capacitance between the diaphragm and the fixed electrode plate that respond to the acoustic vibration.

13. The capacitance sensor according to claim 2, wherein a plurality of holes are formed in the back plate and the fixed electrode plate, and wherein a slit of the back plate passes through the holes and extends in a zigzag form.

14. The capacitance sensor according to claim 2, wherein a plurality of holes are formed in the back plate and the fixed electrode plate, and wherein a slit of the back plate is discontinuously formed to connect the holes to each other.

15. The capacitance sensor according to claim 2, wherein the plurality of slits formed in the back plate are intermittently formed to partition the sensing units from each other.

16. An acoustic sensor using the capacitance sensor according to claim 2, wherein a plurality of holes to cause acoustic vibration to pass are formed in the back plate and the fixed electrode plate, and wherein the sensing unit outputs a signal by a change in electrostatic capacitance between the diaphragm and the fixed electrode plate that respond to the acoustic vibration.

17. The capacitance sensor according to claim 1, wherein, at a peripheral portion of the isolation portion, a stopper is projected from the lower surface of the back plate.

18. The capacitance sensor according to claim 1, wherein the vibration electrode plate is divided by a slit into a plurality of regions, and wherein the isolation portion is located immediately over the slit of the vibration electrode plate.

19. An acoustic sensor using the capacitance sensor according to claim 1, wherein a plurality of holes to cause acoustic vibration to pass are formed in the back plate and the fixed electrode plate, and wherein the sensing unit outputs a signal by a change in electrostatic capacitance between the diaphragm and the fixed electrode plate that respond to the acoustic vibration.

20. A microphone comprising:

the acoustic sensor according to claim 19, and a circuit unit that amplifies a signal from the acoustic sensor to output the amplified signal to the outside.

* * * * *